US008139020B2

(12) United States Patent
Ohshima

(10) Patent No.: US 8,139,020 B2
(45) Date of Patent: Mar. 20, 2012

(54) LIQUID CRYSTAL DISPLAY DEVICE AND IMAGE DISPLAY METHOD THEREOF

(75) Inventor: Yoshinori Ohshima, Yokohama (JP)

(73) Assignee: Victor Company of Japan, Limited, Yokohoma (JP)

( * ) Notice: Subject to any disclaimer, the term of this patent is extended or adjusted under 35 U.S.C. 154(b) by 1027 days.

(21) Appl. No.: 12/046,687

(22) Filed: Mar. 12, 2008

(65) Prior Publication Data

US 2008/0278432 A1 Nov. 13, 2008

(30) Foreign Application Priority Data

May 8, 2007 (JP) ..... 2007-123136
Aug. 10, 2007 (JP) ..... 2007-209818
Aug. 10, 2007 (JP) ..... 2007-209819
Aug. 10, 2007 (JP) ..... 2007-209820

(51) Int. Cl.
*G09G 3/36* (2006.01)

(52) U.S. Cl. ..... 345/102

(58) Field of Classification Search ..... 345/102
See application file for complete search history.

(56) References Cited

U.S. PATENT DOCUMENTS 6,870,525 B2 * 3/2005 Kawabata et al. ..... 345/102
7,008,473 B2 * 3/2006 Butters et al. ..... 96/224
7,808,473 B2 * 10/2010 Kamimura ..... 345/102
2002/0021292 A1 2/2002 Sakashita
2002/0130830 A1 9/2002 Park
2003/0016205 A1 1/2003 Kawabata et al.
2004/0070562 A1 4/2004 Hudson et al.
2005/0140640 A1 6/2005 Oh et al.
2005/0184952 A1 8/2005 Konno et al.
2006/0221046 A1 10/2006 Sato et al.
2006/0238487 A1 10/2006 Shih
2007/0002000 A1 * 1/2007 Kwon ..... 345/102
(Continued)

FOREIGN PATENT DOCUMENTS

CN 1755447 A 4/2006
(Continued)

OTHER PUBLICATIONS

T. Shirai et al., "44.4: RGB-LED Backlights for LCD-TVs with 0D, 1D, and 2D Adaptive Dimming", SID 06 Digest, p. 1520-1523.

(Continued)

*Primary Examiner* — Richard Hjerpe
*Assistant Examiner* — Sahlu Okebato
(74) *Attorney, Agent, or Firm* — Marvin A. Motsenbocker; Mots Law, PLLC

(57) ABSTRACT

A backlight device is divided into multiple regions, and has a configuration in which light emitted from a light source of each of the regions is allowed to leak to other regions. A maximum gradation detector detects a maximum gradation of a regional image signal displayed on each of the regions of the liquid crystal panel. An image gain calculator obtains a gain to be multiplied to each regional image signal. An emission luminance calculator obtains an emission luminance of light to be emitted by each light source, by using an operation expression according to the emission luminance of light to be emitted by the backlight device. At this time, if the emission luminance takes a negative value as a result of calculation, the emission luminance calculator makes a correction so that the emission luminance can take a value equal to or greater than 0.

23 Claims, 28 Drawing Sheets

U.S. PATENT DOCUMENTS

| | | | | |
|---|---|---|---|---|
| 2007/0024573 | A1* | 2/2007 | Kamimura | 345/102 |
| 2008/0111784 | A1 | 5/2008 | Tanaka et al. | |

FOREIGN PATENT DOCUMENTS

| | | | |
|---|---|---|---|
| CN | 1830096 | A | 9/2006 |
| CN | 1838220 | A | 9/2006 |
| EP | 1482475 | A1 | 12/2004 |
| EP | 1705636 | A1 | 9/2006 |
| EP | 1956584 | A2 | 8/2008 |
| EP | 1990796 | A2 | 11/2008 |
| JP | 2002-099250 | A | 4/2002 |
| JP | 2005-258403 | A1 | 9/2005 |
| JP | 2005-346085 | A | 12/2005 |
| JP | 2006-030588 | A1 | 2/2006 |
| JP | 2006-113311 | A | 4/2006 |
| JP | 2006-145886 | A1 | 6/2006 |
| JP | 2008-203292 | A | 9/2008 |

OTHER PUBLICATIONS

T. Shiga, et al.; "Reduction of LCTV backlight power and enhancement of gray scale capability by using an adaptive dimming technique"; SID 03 Digest, pp. 1364-1367 (2003).

* cited by examiner

FIG. 5B
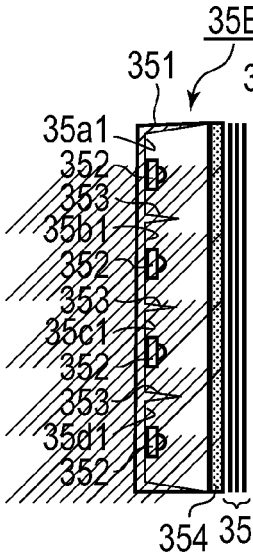
FIG. 5A
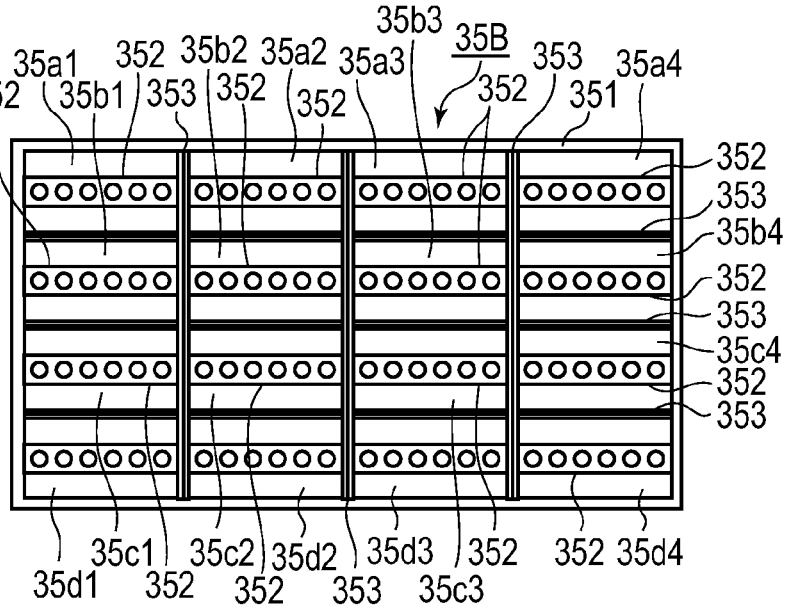
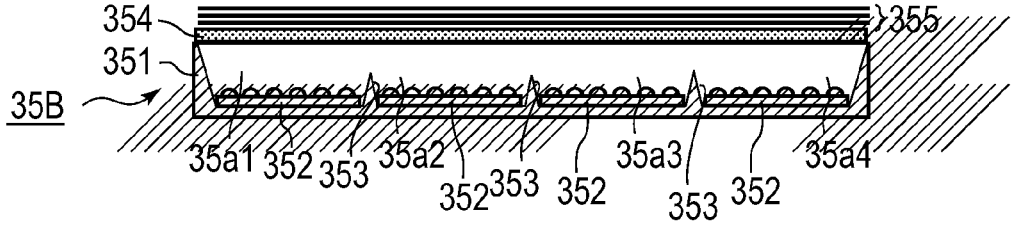
FIG. 5C

FIG. 7

35

| | | | | | | | |
|---|---|---|---|---|---|---|---|
| 35a1 | 35a2 | 35a3 | 35a4 | 35a5 | 35a6 | 35a7 | 35a8 |
| 35b1 | 35b2 | 35b3 | 35b4 | 35b5 | 35b6 | 35b7 | 35b8 |
| 35c1 | 35c2 | 35c3 | 35c4 | 35c5 | 35c6 | 35c7 | 35c8 |
| 35d1 | 35d2 | 35d3 | 35d4 | 35d5 | 35d6 | 35d7 | 35d8 |
| 35e1 | 35e2 | 35e3 | 35e4 | 35e5 | 35e6 | 35e7 | 35e8 |
| 35f1 | 35f2 | 35f3 | 35f4 | 35f5 | 35f6 | 35f7 | 35f8 |
| 35g1 | 35g2 | 35g3 | 35g4 | 35g5 | 35g6 | 35g7 | 35g8 |
| 35h1 | 35h2 | 35h3 | 35h4 | 35h5 | 35h6 | 35h7 | 35h8 |

| | LUMINANCE ON REGION 35a | LUMINANCE ON REGION 35b | LUMINANCE ON REGION 35c | LUMINANCE ON REGION 35d |
|---|---|---|---|---|
| LIGHTING ONLY ON REGION 35a | $Bo_1$ | $kBo_1$ | $k^2Bo_1$ | $k^3Bo_1$ |
| LIGHTING ONLY ON REGION 35b | $kBo_2$ | $Bo_2$ | $kBo_2$ | $k^2Bo_2$ |
| LIGHTING ONLY ON REGION 35c | $k^2Bo_3$ | $kBo_3$ | $Bo_3$ | $kBo_3$ |
| LIGHTING ONLY ON REGION 35d | $k^3Bo_4$ | $k^2Bo_4$ | $kBo_4$ | $Bo_4$ |

FIG. 11A $$\begin{bmatrix} B_1' \\ B_2' \\ B_3' \\ B_4' \end{bmatrix} = \begin{bmatrix} 1 & k & k^2 & k^3 \\ k & 1 & k & k^2 \\ k^2 & k & 1 & k \\ k^3 & k^2 & k & 1 \end{bmatrix} \begin{bmatrix} Bo_1 \\ Bo_2 \\ Bo_3 \\ Bo_4 \end{bmatrix} \quad \cdots (1)$$

FIG. 11B $$\begin{bmatrix} Bo_1 \\ Bo_2 \\ Bo_3 \\ Bo_4 \end{bmatrix} = \begin{bmatrix} 1 & k & k^2 & k^3 \\ k & 1 & k & k^2 \\ k^2 & k & 1 & k \\ k^3 & k^2 & k & 1 \end{bmatrix}^{-1} \begin{bmatrix} B_1' \\ B_2' \\ B_3' \\ B_4' \end{bmatrix} \quad \cdots (2)$$

FIG. 11C $$\begin{bmatrix} Bo_1 \\ Bo_2 \\ Bo_3 \\ Bo_4 \end{bmatrix} = \begin{bmatrix} c & b & 0 & 0 \\ b & a & b & 0 \\ 0 & b & a & b \\ 0 & 0 & b & c \end{bmatrix} \begin{bmatrix} B_1' \\ B_2' \\ B_3' \\ B_4' \end{bmatrix} \quad \cdots (3)$$

FIG. 11D $$a = \frac{1 + k^2}{1 - k^2}, \quad b = \frac{-k}{1 - k^2}, \quad c = \frac{1}{1 - k^2} \quad \cdots (4)$$

FIG. 12

$$\begin{bmatrix} Bo_1 \\ Bo_2 \\ Bo_3 \\ Bo_4 \\ Bo_5 \\ Bo_6 \\ Bo_7 \\ Bo_8 \end{bmatrix} = \begin{bmatrix} c & b & 0 & 0 & 0 & 0 & 0 & 0 \\ b & a & b & 0 & 0 & 0 & 0 & 0 \\ 0 & b & a & b & 0 & 0 & 0 & 0 \\ 0 & 0 & b & a & b & 0 & 0 & 0 \\ 0 & 0 & 0 & b & a & b & 0 & 0 \\ 0 & 0 & 0 & 0 & b & a & b & 0 \\ 0 & 0 & 0 & 0 & 0 & b & a & b \\ 0 & 0 & 0 & 0 & 0 & 0 & b & c \end{bmatrix} \begin{bmatrix} B_1' \\ B_2' \\ B_3' \\ B_4' \\ B_5' \\ B_6' \\ B_7' \\ B_8' \end{bmatrix} \quad \cdots (5)$$

FIG. 13A $$\begin{bmatrix} B_1' \\ B_2' \\ \vdots \\ \vdots \\ B_{n-1}' \\ B_n' \end{bmatrix} = \begin{bmatrix} 1 & k & \cdots & \cdots & k^{n-2} & k^{n-1} \\ k & 1 & \cdots & \cdots & k^{n-3} & k^{n-2} \\ \vdots & \vdots & \ddots & \ddots & \vdots & \vdots \\ \vdots & \vdots & \ddots & \ddots & \vdots & \vdots \\ k^{n-2} & k^{n-3} & \cdots & \cdots & 1 & k \\ k^{n-1} & k^{n-2} & \cdots & \cdots & k & 1 \end{bmatrix} \begin{bmatrix} Bo_1 \\ Bo_2 \\ \vdots \\ \vdots \\ Bo_{n-1} \\ Bo_n \end{bmatrix} \quad \cdots (6)$$

FIG. 13B $$\begin{bmatrix} Bo_1 \\ Bo_2 \\ \vdots \\ \vdots \\ Bo_{n-1} \\ Bo_n \end{bmatrix} = \begin{bmatrix} c & b & \cdots & \cdots & 0 & 0 \\ b & a & \cdots & \cdots & 0 & 0 \\ \vdots & \vdots & \ddots & \ddots & \vdots & \vdots \\ \vdots & \vdots & \ddots & \ddots & \vdots & \vdots \\ 0 & 0 & \cdots & \cdots & a & b \\ 0 & 0 & \cdots & \cdots & b & c \end{bmatrix} \begin{bmatrix} B_1' \\ B_2' \\ \vdots \\ \vdots \\ B_{n-1}' \\ B_n' \end{bmatrix} \quad \cdots (7)$$

FIG. 15A $$\begin{bmatrix} B_{11}' & B_{12}' & B_{13}' & B_{14}' \\ B_{21}' & B_{22}' & B_{23}' & B_{24}' \\ B_{31}' & B_{32}' & B_{33}' & B_{34}' \\ B_{41}' & B_{42}' & B_{43}' & B_{44}' \end{bmatrix} = \begin{bmatrix} 1 & k & k^2 & k^3 \\ k & 1 & k & k^2 \\ k^2 & k & 1 & k \\ k^3 & k^2 & k & 1 \end{bmatrix} \begin{bmatrix} Bo_{11} & Bo_{12} & Bo_{13} & Bo_{14} \\ Bo_{21} & Bo_{22} & Bo_{23} & Bo_{24} \\ Bo_{31} & Bo_{32} & Bo_{33} & Bo_{34} \\ Bo_{41} & Bo_{42} & Bo_{43} & Bo_{44} \end{bmatrix} \begin{bmatrix} 1 & m & m^2 & m^3 \\ m & 1 & m & m^2 \\ m^2 & m & 1 & m \\ m^3 & m^2 & m & 1 \end{bmatrix} \quad \cdots (8)$$

FIG. 15B $$\begin{bmatrix} Bo_{11} & Bo_{12} & Bo_{13} & Bo_{14} \\ Bo_{21} & Bo_{22} & Bo_{23} & Bo_{24} \\ Bo_{31} & Bo_{32} & Bo_{33} & Bo_{34} \\ Bo_{41} & Bo_{42} & Bo_{43} & Bo_{44} \end{bmatrix} = \begin{bmatrix} 1 & k & k^2 & k^3 \\ k & 1 & k & k^2 \\ k^2 & k & 1 & k \\ k^3 & k^2 & k & 1 \end{bmatrix}^{-1} \begin{bmatrix} B_{11}' & B_{12}' & B_{13}' & B_{14}' \\ B_{21}' & B_{22}' & B_{23}' & B_{24}' \\ B_{31}' & B_{32}' & B_{33}' & B_{34}' \\ B_{41}' & B_{42}' & B_{43}' & B_{44}' \end{bmatrix} \begin{bmatrix} 1 & m & m^2 & m^3 \\ m & 1 & m & m^2 \\ m^2 & m & 1 & m \\ m^3 & m^2 & m & 1 \end{bmatrix}^{-1} \quad \cdots (9)$$

FIG. 15C $$\begin{bmatrix} Bo_{11} & Bo_{12} & Bo_{13} & Bo_{14} \\ Bo_{21} & Bo_{22} & Bo_{23} & Bo_{24} \\ Bo_{31} & Bo_{32} & Bo_{33} & Bo_{34} \\ Bo_{41} & Bo_{42} & Bo_{43} & Bo_{44} \end{bmatrix} = \begin{bmatrix} c & b & 0 & 0 \\ b & a & b & 0 \\ 0 & b & a & b \\ 0 & 0 & b & c \end{bmatrix} \begin{bmatrix} B_{11}' & B_{12}' & B_{13}' & B_{14}' \\ B_{21}' & B_{22}' & B_{23}' & B_{24}' \\ B_{31}' & B_{32}' & B_{33}' & B_{34}' \\ B_{41}' & B_{42}' & B_{43}' & B_{44}' \end{bmatrix} \begin{bmatrix} f & e & 0 & 0 \\ e & d & e & 0 \\ 0 & e & d & e \\ 0 & 0 & e & f \end{bmatrix} \quad \cdots (10)$$

FIG. 15D $$a = \frac{1 + k^2}{1 - k^2}, \quad b = \frac{-k}{1 - k^2}, \quad c = \frac{1}{1 - k^2}, \quad d = \frac{1 + m^2}{1 - m^2}, \quad e = \frac{-m}{1 - m^2}, \quad f = \frac{1}{1 - m^2} \quad \cdots (11)$$

FIG. 16A $$\begin{bmatrix} B_{11}' & B_{12}' & B_{13}' & B_{14}' & B_{15}' & B_{16}' & B_{17}' & B_{18}' \\ B_{21}' & B_{22}' & B_{23}' & B_{24}' & B_{25}' & B_{26}' & B_{27}' & B_{28}' \\ B_{31}' & B_{32}' & B_{33}' & B_{34}' & B_{35}' & B_{36}' & B_{37}' & B_{38}' \\ B_{41}' & B_{42}' & B_{43}' & B_{44}' & B_{45}' & B_{46}' & B_{47}' & B_{48}' \\ B_{51}' & B_{52}' & B_{53}' & B_{54}' & B_{55}' & B_{56}' & B_{57}' & B_{58}' \\ B_{61}' & B_{62}' & B_{63}' & B_{64}' & B_{65}' & B_{66}' & B_{67}' & B_{68}' \\ B_{71}' & B_{72}' & B_{73}' & B_{74}' & B_{75}' & B_{76}' & B_{77}' & B_{78}' \\ B_{81}' & B_{82}' & B_{83}' & B_{84}' & B_{85}' & B_{86}' & B_{87}' & B_{88}' \end{bmatrix} = \begin{bmatrix} 1 & k & k^2 & k^3 & k^4 & k^5 & k^6 & k^7 \\ k & 1 & k & k^2 & k^3 & k^4 & k^5 & k^6 \\ k^2 & k & 1 & k & k^2 & k^3 & k^4 & k^5 \\ k^3 & k^2 & k & 1 & k & k^2 & k^3 & k^4 \\ k^4 & k^3 & k^2 & k & 1 & k & k^2 & k^3 \\ k^5 & k^4 & k^3 & k^2 & k & 1 & k & k^2 \\ k^6 & k^5 & k^4 & k^3 & k^2 & k & 1 & k \\ k^7 & k^6 & k^5 & k^4 & k^3 & k^2 & k & 1 \end{bmatrix} \begin{bmatrix} Bo_{11} & Bo_{12} & Bo_{13} & Bo_{14} & Bo_{15} & Bo_{16} & Bo_{17} & Bo_{18} \\ Bo_{21} & Bo_{22} & Bo_{23} & Bo_{24} & Bo_{25} & Bo_{26} & Bo_{27} & Bo_{28} \\ Bo_{31} & Bo_{32} & Bo_{33} & Bo_{34} & Bo_{35} & Bo_{36} & Bo_{37} & Bo_{38} \\ Bo_{41} & Bo_{42} & Bo_{43} & Bo_{44} & Bo_{45} & Bo_{46} & Bo_{47} & Bo_{48} \\ Bo_{51} & Bo_{52} & Bo_{53} & Bo_{54} & Bo_{55} & Bo_{56} & Bo_{57} & Bo_{58} \\ Bo_{61} & Bo_{62} & Bo_{63} & Bo_{64} & Bo_{65} & Bo_{66} & Bo_{67} & Bo_{68} \\ Bo_{71} & Bo_{72} & Bo_{73} & Bo_{74} & Bo_{75} & Bo_{76} & Bo_{77} & Bo_{78} \\ Bo_{81} & Bo_{82} & Bo_{83} & Bo_{84} & Bo_{85} & Bo_{86} & Bo_{87} & Bo_{88} \end{bmatrix} \begin{bmatrix} 1 & m & m^2 & m^3 & m^4 & m^5 & m^6 & m^7 \\ m & 1 & m & m^2 & m^3 & m^4 & m^5 & m^6 \\ m^2 & m & 1 & m & m^2 & m^3 & m^4 & m^5 \\ m^3 & m^2 & m & 1 & m & m^2 & m^3 & m^4 \\ m^4 & m^3 & m^2 & m & 1 & m & m^2 & m^3 \\ m^5 & m^4 & m^3 & m^2 & m & 1 & m & m^2 \\ m^6 & m^5 & m^4 & m^3 & m^2 & m & 1 & m \\ m^7 & m^6 & m^5 & m^4 & m^3 & m^2 & m & 1 \end{bmatrix} \quad \cdots (12)$$

FIG. 16B $$\begin{bmatrix} Bo_{11} & Bo_{12} & Bo_{13} & Bo_{14} & Bo_{15} & Bo_{16} & Bo_{17} & Bo_{18} \\ Bo_{21} & Bo_{22} & Bo_{23} & Bo_{24} & Bo_{25} & Bo_{26} & Bo_{27} & Bo_{28} \\ Bo_{31} & Bo_{32} & Bo_{33} & Bo_{34} & Bo_{35} & Bo_{36} & Bo_{37} & Bo_{38} \\ Bo_{41} & Bo_{42} & Bo_{43} & Bo_{44} & Bo_{45} & Bo_{46} & Bo_{47} & Bo_{48} \\ Bo_{51} & Bo_{52} & Bo_{53} & Bo_{54} & Bo_{55} & Bo_{56} & Bo_{57} & Bo_{58} \\ Bo_{61} & Bo_{62} & Bo_{63} & Bo_{64} & Bo_{65} & Bo_{66} & Bo_{67} & Bo_{68} \\ Bo_{71} & Bo_{72} & Bo_{73} & Bo_{74} & Bo_{75} & Bo_{76} & Bo_{77} & Bo_{78} \\ Bo_{81} & Bo_{82} & Bo_{83} & Bo_{84} & Bo_{85} & Bo_{86} & Bo_{87} & Bo_{88} \end{bmatrix} = \begin{bmatrix} c & b & 0 & 0 & 0 & 0 & 0 & 0 \\ b & a & b & 0 & 0 & 0 & 0 & 0 \\ 0 & b & a & b & 0 & 0 & 0 & 0 \\ 0 & 0 & b & a & b & 0 & 0 & 0 \\ 0 & 0 & 0 & b & a & b & 0 & 0 \\ 0 & 0 & 0 & 0 & b & a & b & 0 \\ 0 & 0 & 0 & 0 & 0 & b & a & b \\ 0 & 0 & 0 & 0 & 0 & 0 & b & c \end{bmatrix} \begin{bmatrix} B_{11}' & B_{12}' & B_{13}' & B_{14}' & B_{15}' & B_{16}' & B_{17}' & B_{18}' \\ B_{21}' & B_{22}' & B_{23}' & B_{24}' & B_{25}' & B_{26}' & B_{27}' & B_{28}' \\ B_{31}' & B_{32}' & B_{33}' & B_{34}' & B_{35}' & B_{36}' & B_{37}' & B_{38}' \\ B_{41}' & B_{42}' & B_{43}' & B_{44}' & B_{45}' & B_{46}' & B_{47}' & B_{48}' \\ B_{51}' & B_{52}' & B_{53}' & B_{54}' & B_{55}' & B_{56}' & B_{57}' & B_{58}' \\ B_{61}' & B_{62}' & B_{63}' & B_{64}' & B_{65}' & B_{66}' & B_{67}' & B_{68}' \\ B_{71}' & B_{72}' & B_{73}' & B_{74}' & B_{75}' & B_{76}' & B_{77}' & B_{78}' \\ B_{81}' & B_{82}' & B_{83}' & B_{84}' & B_{85}' & B_{86}' & B_{87}' & B_{88}' \end{bmatrix} \begin{bmatrix} f & e & 0 & 0 & 0 & 0 & 0 & 0 \\ e & d & e & 0 & 0 & 0 & 0 & 0 \\ 0 & e & d & e & 0 & 0 & 0 & 0 \\ 0 & 0 & e & d & e & 0 & 0 & 0 \\ 0 & 0 & 0 & e & d & e & 0 & 0 \\ 0 & 0 & 0 & 0 & e & d & e & 0 \\ 0 & 0 & 0 & 0 & 0 & e & d & e \\ 0 & 0 & 0 & 0 & 0 & 0 & e & f \end{bmatrix} \quad \cdots (13)$$

FIG. 17

$$\begin{bmatrix} Bo_{11} & Bo_{12} & Bo_{13} & \cdots & \cdots & Bo_{1,n-2} & Bo_{1,n-1} & Bo_{1,n} \\ Bo_{21} & Bo_{22} & Bo_{23} & \cdots & \cdots & Bo_{2,n-2} & Bo_{2,n-1} & Bo_{2,n} \\ Bo_{31} & Boo_{32} & Bo_{33} & \cdots & \cdots & Bo_{3,n-2} & Bo_{3,n-1} & Bo_{3,n} \\ \vdots & \vdots & \vdots & \ddots & \ddots & \vdots & \vdots & \vdots \\ \vdots & \vdots & \vdots & \ddots & \ddots & \vdots & \vdots & \vdots \\ Bo_{n-2,1} & Bo_{n-2,2} & Bo_{n-2,3} & \cdots & \cdots & Bo_{n-2,n-2} & Bo_{n-2,n-1} & Bo_{n-2,n} \\ Bo_{n-1,1} & Bo_{n-1,2} & Bo_{n-1,3} & \cdots & \cdots & Bo_{n-1,n-2} & Bo_{n-1,n-1} & Bo_{n-1,n} \\ Bo_{n,1} & Bo_{n,2} & Bo_{n,3} & \cdots & \cdots & Bo_{n,n-2,} & Bo_{n,n-1} & Bo_{n,n} \end{bmatrix} = \begin{bmatrix} c & b & 0 & \cdots & \cdots & 0 & 0 & 0 \\ b & a & b & \cdots & \cdots & 0 & 0 & 0 \\ 0 & b & a & \cdots & \cdots & 0 & 0 & 0 \\ \vdots & \vdots & \vdots & \ddots & \ddots & \vdots & \vdots & \vdots \\ \vdots & \vdots & \vdots & \ddots & \ddots & \vdots & \vdots & \vdots \\ 0 & 0 & 0 & \cdots & \cdots & a & b & 0 \\ 0 & 0 & 0 & \cdots & \cdots & b & a & b \\ 0 & 0 & 0 & \cdots & \cdots & 0 & b & c \end{bmatrix} \begin{bmatrix} B_{11}' & B_{12}' & B_{13}' & \cdots & \cdots & B_{1,n-2}' & B_{1,n-1}' & B_{1,n}' \\ B_{21}' & B_{22}' & B_{23}' & \cdots & \cdots & B_{2,n-2}' & B_{2,n-1}' & B_{2,n}' \\ B_{31}' & B_{32}' & B_{33}' & \cdots & \cdots & B_{3,n-2}' & B_{3,n-1}' & B_{3,n}' \\ \vdots & \vdots & \vdots & \ddots & \ddots & \vdots & \vdots & \vdots \\ \vdots & \vdots & \vdots & \ddots & \ddots & \vdots & \vdots & \vdots \\ B_{n-2,1}' & B_{n-2,2}' & B_{n-2,3}' & \cdots & \cdots & B_{n-2,n-2}' & B_{n-2,n-1}' & B_{n-2,n}' \\ B_{n-1,1}' & B_{n-1,2}' & B_{n-1,3}' & \cdots & \cdots & B_{n-1,n-2}' & B_{n-1,n-1}' & B_{n-1,n}' \\ B_{n,1}' & B_{n,2}' & B_{n,3}' & \cdots & \cdots & B_{n,n-2}' & B_{n-1,1}' & B_{n,n}' \end{bmatrix} \begin{bmatrix} f & e & 0 & \cdots & \cdots & 0 & 0 & 0 \\ e & d & e & \cdots & \cdots & 0 & 0 & 0 \\ 0 & e & d & \cdots & \cdots & 0 & 0 & 0 \\ \vdots & \vdots & \vdots & \ddots & \ddots & \vdots & \vdots & \vdots \\ \vdots & \vdots & \vdots & \ddots & \ddots & \vdots & \vdots & \vdots \\ 0 & 0 & 0 & \cdots & \cdots & d & e & 0 \\ 0 & 0 & 0 & \cdots & \cdots & e & d & e \\ 0 & 0 & 0 & \cdots & \cdots & 0 & e & f \end{bmatrix}$$

$$\cdots (14)$$

FIG. 23A $$\begin{bmatrix} B_{oig_1} \\ B_{oig_2} \\ B_{oig_3} \\ B_{oig_4} \end{bmatrix} = \begin{bmatrix} s_1 & 0 & 0 & 0 \\ 0 & s_2 & 0 & 0 \\ 0 & 0 & s_3 & 0 \\ 0 & 0 & 0 & s_4 \end{bmatrix} \begin{bmatrix} B_{o_1} \\ B_{o_2} \\ B_{o_3} \\ B_{o_4} \end{bmatrix} \cdots (15)$$

FIG. 23B $$s_1 = 1 + k, \quad s_2 = \frac{1 + k}{1 - k}, \quad s_3 = \frac{1 + k}{1 - k}, \quad s_4 = 1 + k \quad \cdots (16)$$

FIG. 24A $$Boig_1 = Bo_1 + kBo_1 + k^2Bo_1 + k^3Bo_1 \quad \cdots (17)$$

FIG. 24B $$Boig_1 = \frac{1}{1-k} Bo_1 = (1+k)\, Bo_1 \quad \cdots (18)$$

FIG. 24C $$Boig_2 = kBo_2 + Bo_2 + kBo_2 + k^2Bo_2 \quad \cdots (19)$$

FIG. 24D $$Boig_2 = \frac{kBo_2}{1-k} + \frac{Bo_2}{1-k} = \frac{1+k}{1-k} Bo_2 \quad \cdots (20)$$

FIG. 25A $$\begin{bmatrix} Boig_{11} & Boig_{12} & Boig_{13} & Boig_{14} \\ Boig_{21} & Boig_{22} & Boig_{23} & Boig_{24} \\ Boig_{31} & Boig_{32} & Boig_{33} & Boig_{34} \\ Boig_{41} & Boig_{42} & Boig_{43} & Boig_{44} \end{bmatrix} = \begin{bmatrix} s_1 & 0 & 0 & 0 \\ 0 & s_2 & 0 & 0 \\ 0 & 0 & s_3 & 0 \\ 0 & 0 & 0 & s_4 \end{bmatrix} \begin{bmatrix} Bo_{11} & Bo_{12} & Bo_{13} & Bo_{14} \\ Bo_{21} & Bo_{22} & Bo_{23} & Bo_{24} \\ Bo_{31} & Bo_{32} & Bo_{33} & Bo_{34} \\ Bo_{41} & Bo_{42} & Bo_{43} & Bo_{44} \end{bmatrix} \begin{bmatrix} t_1 & 0 & 0 & 0 \\ 0 & t_2 & 0 & 0 \\ 0 & 0 & t_3 & 0 \\ 0 & 0 & 0 & t_4 \end{bmatrix} \quad \cdots (21)$$

FIG. 25B $$t_1 = 1 + m,\ t_2 = \frac{1+m}{1-m},\ t_3 = \frac{1+m}{1-m},\ t_4 = 1 + m \quad \cdots (22)$$

FIG. 28A $B_1 < k \times B_2$, $B_1 < k \times (B_{i-1} + B_{i+1}) / (1 + k^2)$, $B_n < k \times B_{n-1}$ ••• (23)

FIG. 28B $B_1 \geq k \times B_2$, $B_1 \geq k \times (B_{i-1} + B_{i+1}) / (1 + k^2)$, $B_n \geq k \times B_{n-1}$ ••• (24)

FIG. 28C $B_1 = k \times B_2$, $B_1 = k \times (B_{i-1} + B_{i+1}) / (1 + k^2)$, $B_n = k \times B_{n-1}$ ••• (25)

FIG. 29A $B_{1,j} < k \times B_{2,j}$, $B_{1,j} < k \times (B_{i-1,j} + B_{i+1,j}) / (1 + k^2)$, $B_{n,j} < k \times B_{n-1,j}$ ••• (26)

FIG. 29B $B_{1,j} \geq k \times B_{2,j}$, $B_{1,j} \geq k \times (B_{i-1,j} + B_{i+1,j}) / (1 + k^2)$, $B_{n,j} \geq k \times B_{n-1,j}$ ••• (27)

FIG. 29C $B_{1,j} = k \times B_{2,j}$, $B_{1,j} = k \times (B_{i-1,j} + B_{i+1,j}) / (1 + k^2)$, $B_{n,j} = k \times B_{n-1,j}$ ••• (28)

FIG. 29D $B_{i,1} < m \times B_{i,2}$, $B_{i,j} < m \times (A_{i,j-1} + A_{i,j+1}) / (1 + m^2)$, $B_{i,n} < m \times B_{i,n-1}$ ••• (29)

FIG. 29E $B_{i,1} \geq m \times B_{i,2}$, $B_{i,j} \geq m \times (A_{i,j-1} + A_{i,j+1}) / (1 + m^2)$, $B_{i,n} \geq m \times B_{i,n-1}$ ••• (30)

FIG. 29F $B_{i,1} = m \times B_{i,2}$, $B_{i,j} = m \times (A_{i,j-1} + A_{i,j+1}) / (1 + m^2)$, $B_{i,n} = m \times B_{i,n-1}$ ••• (31)

LIQUID CRYSTAL DISPLAY DEVICE AND IMAGE DISPLAY METHOD THEREOF

CROSS REFERENCE TO RELATED APPLICATIONS

This application claims priority based on 35 USC 119 from prior Japanese Patent Applications No. P2007-123136 filed on May 8, 2007, No. P2007-209818 filed on Aug. 10, 2007, No. P2007-209819 filed on Aug. 10, 2007, and No. P2007-209820 filed on Aug. 10, 2007, the entire contents of which are incorporated herein by reference.

BACKGROUND OF THE INVENTION

1. Field of the Invention

The present invention relates to a liquid crystal display device having a backlight device, and to an image display method for displaying an image signal while controlling light emission of the backlight device.

2. Description of the Related Art

In a liquid crystal display device displaying an image using a liquid crystal panel, the liquid crystal panel itself does not emit light. Therefore, a backlight device is provided, for example, on the back of the liquid crystal panel. The liquid crystal in the panel is switched between an OFF state and an ON state according to applied voltage. When in the OFF state, the liquid crystal panel interrupts light, while, in the ON state, the liquid crystal panel transmits light. For this reason, the liquid crystal display device drives, as electric shutters, multiple pixels within the liquid crystal panel, by controlling the voltage applied to each of the multiple pixels. An image forms by this control of transmission of light from the backlight through the panel.

A cold cathode tube (CCFL (cold cathode fluorescent lamp)) has heretofore been mainly used as a backlight in a backlight device. When using a CCFL in the backlight device, it is common to keep the CCFL at a certain constant lighting state regardless of the brightness of an image signal to be displayed by the liquid crystal panel.

A large share of power consumption by a conventional liquid crystal display device is for the backlight device. Therefore, a liquid crystal display device has a problem of needing a large power consumption in order to keep the backlight in the constant lighting state. For the purpose of solving this problem, various methods have been proposed wherein a light emitting diode (LED) is used as a backlight. The emission luminance of the LED changes according to the brightness of the image signal.

For examples of the letter, see the description of "T. Shirai, S. Shimizukawa, T. Shiga, and S. Mikoshiba, 44.4: RGB-LED Backlights for LCD-TVs with 0D, 1D, and 2D Adaptive Dimming, 1520 SID 06 DIGEST (Non-patent Document 1, below)" and Japanese Patent Application Laid-open Publications Nos. 2005-258403 (Patent Document 1), 2006-30588 (Patent Document 2) and 2006-145886 (Patent Document 3), which describe a backlight device including multiple LEDs that is divided into multiple regions. The emission luminance of the backlight for each region is controlled according to the brightness of the image signal. In particular, Non-patent Document 1 refers to this technique as "adaptive dimming."

In the conventional liquid crystal display device described in Non-patent Document 1, the multiple divided regions of the backlight device are each partitioned by a light shielding wall. The emission luminance of each region is controlled entirely independently according to the image signal strength for each respective region. The LEDs vary in brightness and color, device by device, for their principal wavelength. The degree of such variation differs among colors of red (R), green (G) and blue (B). For this reason, when the multiple regions of the backlight device are completely separated from each other, the brightness and color varies among the regions. As a result, this produces the problem that an image displayed on the liquid crystal panel differs from an original image.

The brightness and light emission wavelength of an LED has a temperature dependence. In particular, an R LED emits less amounts of light with an increase in device temperature, and also experiences a large change of wavelength. In addition, the R, G and B devices have different properties in terms of age deterioration. For this reason, the foregoing problem is particularly acute due to change in temperatures of the LED devices and due to age deterioration of the LED devices.

In the configuration wherein the regions are completely separated from each other, it is difficult to determine the locations of adjacent regions of a particular pixel located above a boundary between the adjacent regions. This is because the manufacturing accuracy of the backlight device is far lower than that of the liquid crystal panel. For this reason, the configuration described in Non-patent Document 1 is not very useful.

In addition, as disclosed in non-patent document 1 and in patent documents 1 to 3, power consumption can be reduced by employing a configuration wherein a backlight device is divided into multiple regions, and in which the emission luminance of a backlight for each region is controlled according to the brightness of an image signal. Power consumption, however, is expected to be further reduced.

SUMMARY OF THE INVENTION

An aspect of the invention provides a liquid crystal display device that comprises: a liquid crystal panel configured to display an image from image signals; a backlight divided into regions and disposed on the back side of the liquid crystal panel, the backlight comprising light sources in the respective regions, the light sources positioned to emit light into the liquid crystal panel, and the backlight having a structure in which light emitted from each of the light sources of the plurality of regions is allowed to leak to regions other than the respective light source region; a maximum gradation detector configured to detect regional image signals at predetermined intervals displayed onto regions of the liquid crystal panel that correspond to the regions of the backlight device; an image gain calculator configured to determine a gain value by dividing a second maximum gradation by the first maximum gradation, the second maximum gradation being a possible maximum gradation of the regional image signal and determined based on the number of bits of the regional image signal; a multiplier configured to multiply a regional image signal by the gain obtained by the image gain calculator, and to output image signals for display on the liquid crystal panel; and an emission luminance calculator configured to determine the second emission luminance by multiplying a first emission luminance by a first coefficient, wherein the first emission luminance is the luminance from each region of the backlight obtained by multiplying the maximum luminance from the light source by the inverse number of the gain obtained by the image gain calculator, wherein the first coefficient is determined from the amount of light that leaks out of the other light source regions into a given region, and wherein the second emission luminance is the luminance of light that each of the light sources of the plurality of regions of the backlight independently emit to obtain the first emission luminance.

According to this embodiment of a liquid crystal display device, the backlight device is divided into multiple regions and the emission luminance of a backlight for each region is controlled by the strength of an image signal. With this control, variations in brightness and color among the regions can be reduced. Accordingly, the quality of an image displayed on the liquid crystal panel can be improved. Moreover, when the emission luminance is made non-uniform, the power consumption of the backlight device can be further reduced.

Another aspect of the invention provides an image displaying method that comprises: detecting, at predetermined intervals, a first maximum gradation of each regional image signal displayed on regions of a liquid crystal panel, while treating image signals to be displayed on the liquid crystal panel as regional image signals respectively corresponding to regions of the liquid crystal panel; obtaining, a gain factor for each regional image signal, by dividing a second maximum gradation by the first maximum gradation, the second maximum gradation is a possible maximum gradation of the regional image signal and determined according to the number of bits of the regional image signal; multiplying the regional image signal by the gain factor and supplying the resultant regional image signal to the liquid crystal panel; obtaining a second emission luminance by multiplying a first emission luminance with a first coefficient, wherein a backlight device of the liquid crystal panel is divided into regions corresponding to the regions of the liquid crystal panel, where the first emission luminance is light emitted by each region of the backlight device, and is obtained by multiplying the maximum light source luminance by the inverse of the gain obtained by the image gain calculator, where the second emission luminance is the luminance that each light source from regions of the backlight device should independently emit to obtain the first emission luminance, and wherein the first coefficient is based on the amount of light that is emitted from each region light source and allowed to leak to other regions; and displaying an image signal on each liquid crystal panel region, the image signal obtained by multiplying the corresponding regional image signal by the gain, while causing a light source for each region of the backlight device to emit light based on the second emission luminance.

BRIEF DESCRIPTION OF THE DRAWINGS

FIGS. 5A to 5C show a second configuration example of backlight device 35.

FIG. 7 is a diagram showing an example of a 2-dimensional region division of backlight device 35.

FIGS. 9A and 9B are views that describe leakage lights in each region of backlight device 35.

FIG. 10 is a diagram showing luminance of each light emitted from corresponding regions when each region of backlight device 35 is individually turned on.

FIGS. 11A to 11D show matrix equations used in the first to fourth embodiments when backlight device 35 is region-divided in one-dimension.

FIG. 12 shows a matrix equation used in the first to fourth embodiments when the backlight device 35 is region-divided in one dimension.

FIGS. 13A and 13B show matrix equations obtained by generalizing the matrix equations shown in FIGS. 11 and 12.

FIGS. 15A to 15D show matrix equations used in the first to fourth embodiments when the backlight device 35 is region-divided in two dimensions.

FIGS. 16A and 16B show matrix equations used in the first to fourth embodiments when the backlight device 35 is region-divided in two dimensions.

FIG. 17 shows a matrix equation obtained by generalizing the matrix equations shown in FIGS. 15 and 16.

FIGS. 23A and 23B show matrix equations each for converting a light emission luminance of the light source into an amount of emitted light.

FIG. 24 shows equations for describing the matrix equations in FIGS. 23A and 23B.

FIGS. 25A and 25B show matrix equations each for converting a light emission luminance of the light source into an amount of emitted light.

FIGS. 28A to 28C are expressions for describing the correction of a light emission luminance in the third embodiment.

FIGS. 29A to 29F are expressions for describing the correction of a light emission luminance in the third embodiment.

DETAILED DESCRIPTION OF EMBODIMENTS

First Embodiment

Figure 1:
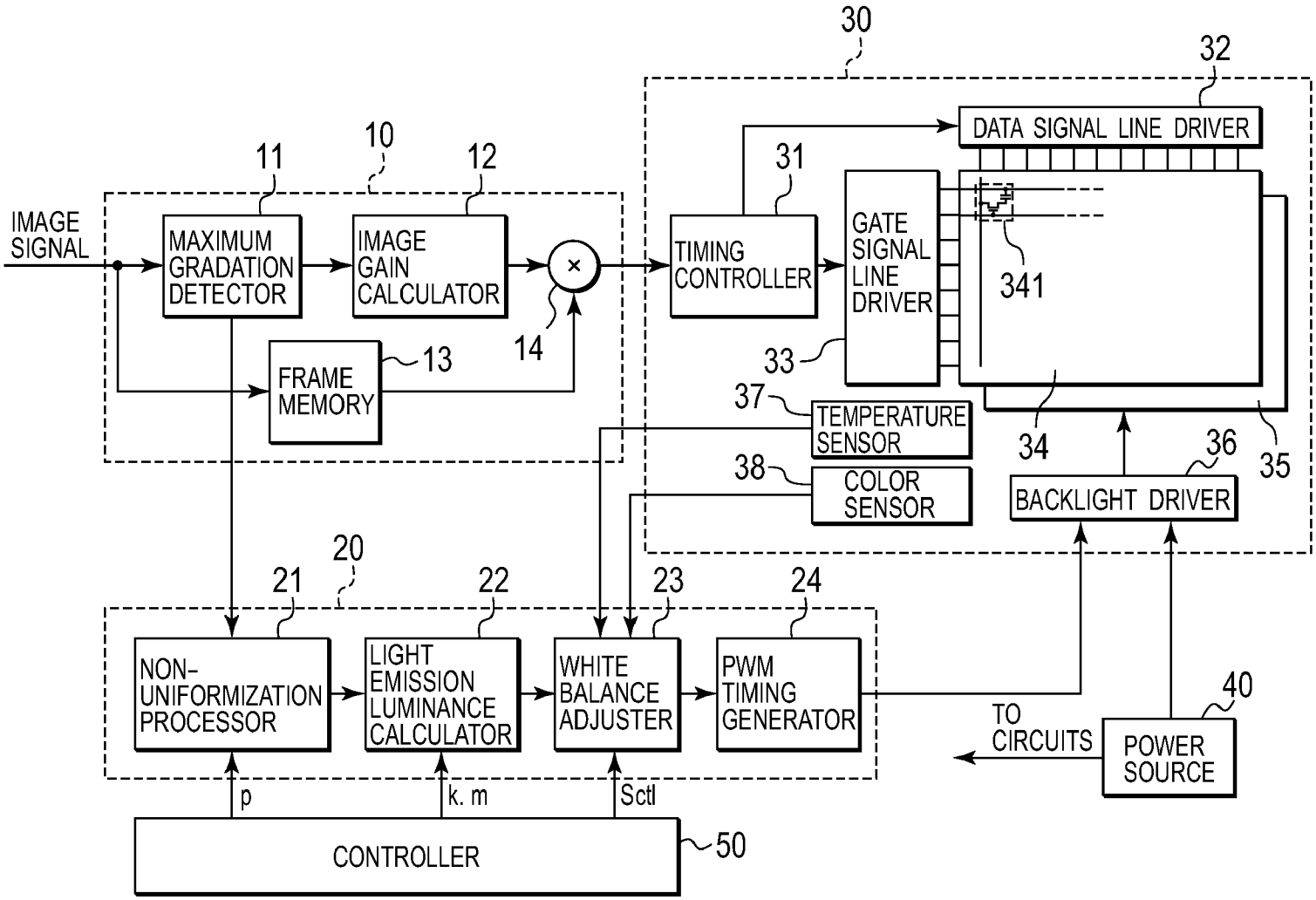
FIG. 1 is a block diagram showing an entire configuration of a liquid crystal display device according to a first embodiment

A liquid crystal display device of a first embodiment and an image display method to be used in this device will be described below with reference to the accompanying drawings. FIG. 1 is a block diagram showing an entire configuration of the liquid crystal display device of the first embodiment. In FIG. 1, an image signal to be displayed on liquid crystal panel 34 in liquid module unit 30, which will be described later, is supplied to a maximum gradation detector 11 and frame memory 13 in image signal processor 10. As will be described later in detail, backlight device 35 is divided into a plurality of regions, and liquid crystal panel 34 is divided into a plurality of regions so that these divided regions, respectively, correspond to the divided regions of backlight device 35, whereby luminance of the backlight (amount of light) is controlled in every region of liquid crystal panel 34.

Figure 2:
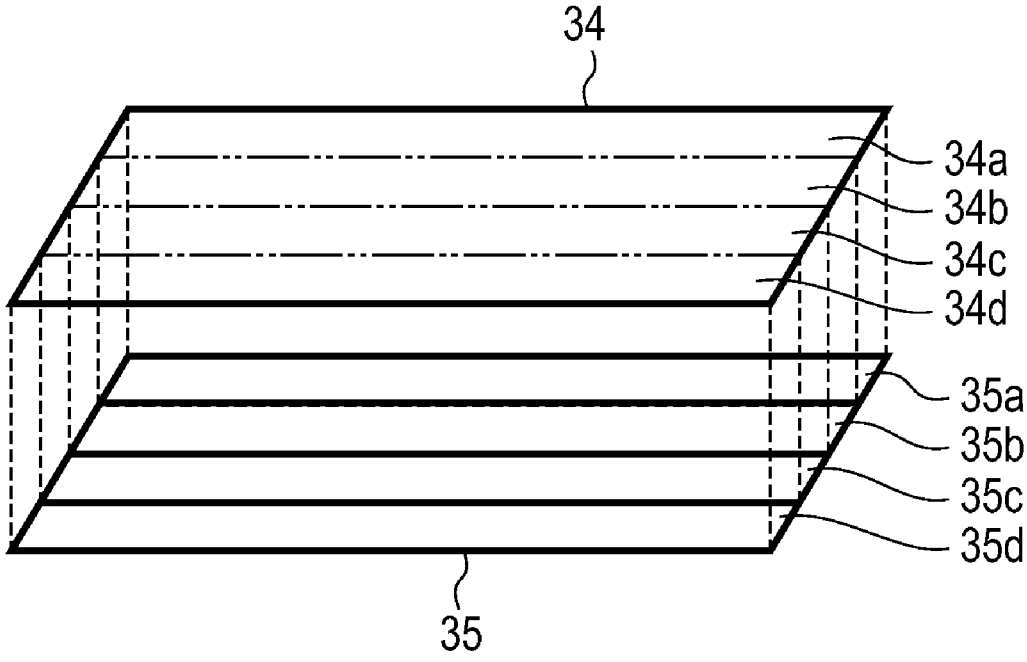
FIG. 2 is a perspective view schematically showing the relationship between a region of liquid crystal panel 34 and a corresponding region of backlight device 35.

FIG. 2 is a view showing an example of region divisions of liquid crystal panel 34 and of backlight device 35, while showing a schematic perspective view of a relationship between regions of liquid crystal panel 34 and regions of backlight device 35. As readily understood, liquid crystal panel 34 and backlight device 35 are arranged so that liquid crystal panel 34 and backlight device 35 are spaced away from each other. As shown in FIG. 2, backlight device 35 is divided in regions 35*a* to 35*d*, and each of regions 35*a* to 35*d* have backlights, respectively. Liquid crystal panel 34 includes a plurality of pixels consisting of, for example, 1920 pixels in the horizontal direction, and 1080 pixels in the vertical direction. Liquid crystal panel 34 has a plurality of pixels divided into regions 34*a* to 34*d* so that these regions 34*a* to 34*d* can correspond to regions 35*a* to 35*d* of backlight device 35. In this example, since liquid crystal panel 34 is one-dimensionally divided into four regions, i.e., regions 34*a* to 34*d*, in a vertical direction, one region contains 270 pixels in the vertical direction. However, the pixels, concluded in each of four regions 34*a* to 34*d*, may naturally be scattered in the vertical direction.

Liquid crystal panel 34 is not physically divided into regions 34*a* to 34*d*, but multiple regions (here, regions 34*a* to 34*d*) are set on liquid crystal panel 34. Image signals to be supplied to liquid crystal panel 34 correspond to multiple regions set on liquid crystal panel 34, and processed as image signals for respective regions, which are respectively displayed on the plurality of regions. Image signals, which are supplied to liquid crystal panel 34, are processed as respective image signals corresponding to the multiple regions, which are to be displayed on the multiple regions set on liquid crystal panel 34. For each multiple region set on liquid crystal panel 34, the luminances of the backlights are individually controlled.

In the example shown in FIG. 2, liquid crystal panel 34 is vertically divided into four regions. In accordance with the divisions of liquid crystal panel 34, backlight device 35 also is vertically divided into four regions. These regions may be further divided (sectioned). Further, as will be described later, liquid crystal panel 34 is divided in both vertical and horizontal directions. Corresponding to this division, backlight device 35 also may be divided in both vertical and horizontal directions. Preferably the number of divided (sectioned) regions are larger and partitioning (sectioning) in both vertical and horizontal directions is better than partitioning (zoning) in the horizontal direction only. Here, for the sake of simplicity, the operation of FIG. 1 is described, with four vertically divided regions shown in FIG. 2 as an example.

Returning back to FIG. 1, with respect to every frame of an image signal, maximum gradation detector 11 detects maximum gradations of each image signal displayed on respective regions 34*a* to 34*d* of liquid crystal panel 34. Preferably a maximum gradation is detected for every frame of an image signal, but a maximum gradation may be detected for every two frame depending on circumstances. In either case, the detector may detect the maximum gradation for every unit of time determined in advance. Each data point, which represents a maximum gradation on regions 34*a* to 34*d* as detected by maximum gradation detector 11, is supplied to gain calculator 12 and non-uniformization processor 21. Calculator 12 within image signal processor 10 and processor 21 is within backlight luminance controller 20. Image gain calculator 12 calculates a gain, by which image signals to be displayed on regions 34*a* to 34*d* are multiplied, in the following manner.

FIGS. 3A to 3D describe a gain calculation process which is operated in the image gain calculator 12. For every image signal supplied to each of regions 34*a* to 34*d* of liquid crystal panel 34, a gain to be multiplied to an image signal is obtained. Accordingly, a gain calculation, as described below, is performed on each image signal supplied to regions 34*a* to 34*d*. Note that in FIGS. 3A to 3D, an input signal (image signal) indicated on the horizontal axis is represented in 8-bit, 0 to 255 gradation. In addition, display luminance (display gradation) of liquid crystal panel 34 indicated on the vertical axis takes a value from 0 to 255 for the sake of simplicity, without consideration of transmissivity of liquid crystal panel 34. Bit number of the image signal is not limited to 8-bits, but may be for example, 10-bits.

Figure 3A:
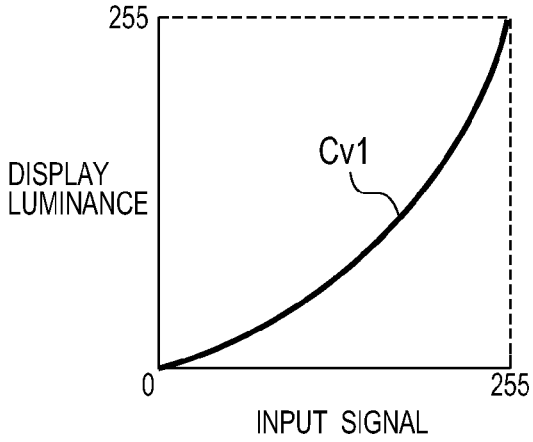
FIGS. 3A to 3D are graphs for describing a calculation process in which a gain is obtained by image gain calculator 12 shown in FIG. 1.

A curve Cv1 in FIG. 3A shows how display luminance for an image signal having gradation of 0 to 255 is presented on liquid crystal panel 34. With the horizontal axis denoted by x and the vertical axis denoted by y, curve Cv1 is represented by a curve in which y is a function of x to the power of 2.2 to 2.4. This curve usually is referred to as a gamma curve with a gamma of 2.2 to 2.4. The curve in FIG. 3A may not be represented by the gamma curve Cv1, according to the kind of the liquid crystal panel 34.

Figure 3B:
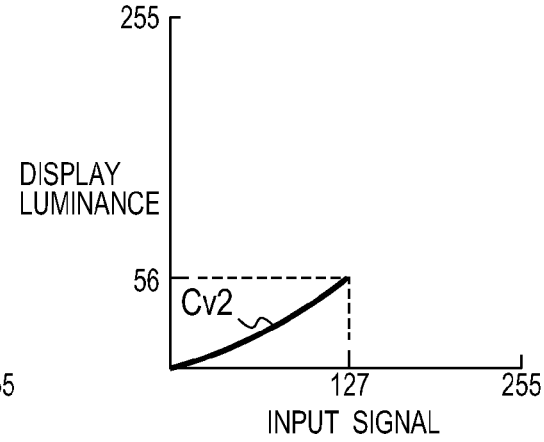
Figure 3C:
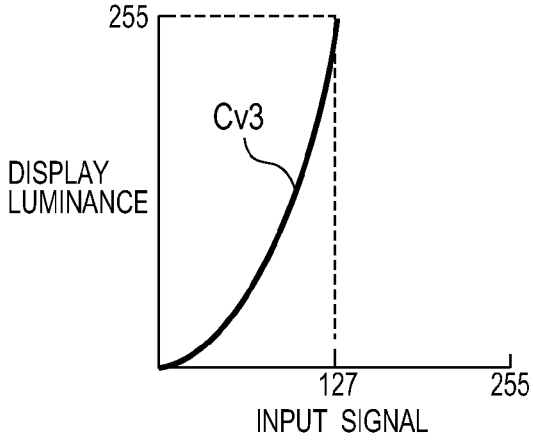
Figure 3D:
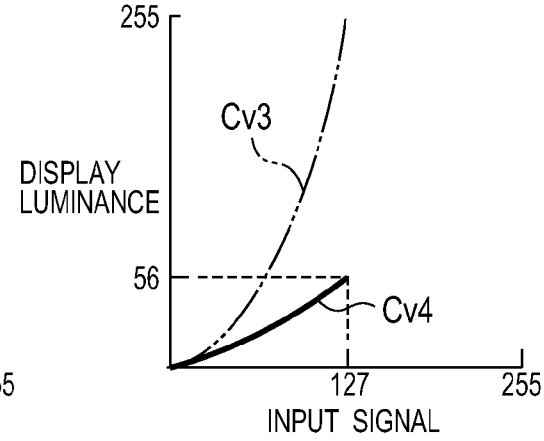

Now, as an example, assume that maximum gradation is 127, and an input signal takes a gradation from 0 to 127 as shown in FIG. 3B. The display luminance of liquid crystal panel 34 for this case is represented by curve Cv2 with the value of the display luminance from 0 to 56. At this time, it is assumed that a backlight emits light at the gradation of the maximum luminance, 255. The maximum luminance of a backlight is the luminance at which the backlight emits light when an image signal has the maximum gradation 255 (i.e., white). When multiplying a gain of approximately 4.5 to an image signal as indicated by the curve Cv2 of FIG. 3B, the result becomes curve Cv3 indicated in FIG. 3C. The gain of approximately 4.5 is obtained from 255/56. Even also for a state of FIG. 3C, it is assumed that the backlight emits light at a maximum luminance.

In this state, an image signal having characteristics indicated by curve Cv3 differs from an initial signal having characteristics indicated by curve Cv2 of FIG. 3B. In addition, backlights consume unnecessary power. Accordingly, the light emission luminance of the backlights is set to approximately 1/4.5 of the maximum luminance, so that the curve Cv3, with a display luminance of 0 to 255 can become curve Cv4 with display luminance of 0 to 56. Thus, an image signal having characteristics indicated by the curve Cv4 substantially becomes equivalent to that having characteristics indicated by curve Cv2, and power consumption of the backlights is reduced.

To be more precise, here, assume that Gmax1 denotes a maximum gradation of an image signal displayed on each of regions 34*a* to 34*d* within one frame period, and that Gmax0 denotes a possible maximum gradation of the image signal. The achievable maximum gradation is determined according to the number of bits of image signals. Then, image gain calculator 12 sets Gmax0/Gmax1 for each of regions 34*a* to 34*d* as a gain to be multiplied to an image signal being displayed on each of regions 34*a* to 34*d*. Gmax1/Gmax0, which is an inverse number of the gain Gmax0/Gmax1, is used to control luminance of the backlights in backlight luminance controller 20. When picture patterns of image signals to be displayed on regions 34*a* to 34*d* differ from each other, maximum gradations Gmax1 of the respective regions 34*a* to 34*d* inevitably differ from each other. Accordingly, Gmax0/Gmax1 varies for each one of regions 34*a* to 34*d*. The configuration and operation of backlight luminance controller 20 will be described in detail later.

In FIG. 1, a gain for each one of regions 34*a* to 34*d* calculated by image gain calculator 12 is inputted into multiplier 14. Multiplier 14 multiplies gains respectively to image signals being outputted from frame memory 13, and outputs the multiplied image signals for display on regions 34*a* to 34*d*.

Image signals outputted from multiplier 14 are supplied to timing controller 31 in liquid module unit 30. Liquid crystal panel 34 includes multiple pixels 341 as previously described. Data signal line driver 32 is connected to data signal lines of pixels 341, and gate signal line driver 33 is connected to gate signal lines. An image signal inputted to timing controller 31 is supplied to data signal line driver 32. Timing controller 31 controls timings at which image signals are written on liquid crystal panel 34, by data signal line driver 32 and gate signal line driver 33. Pixel data constituting respective lines of image signals inputted in data signal line driver 32 are written in sequence in pixels of respective lines one by one through the driving of the gate signal lines by gate signal line driver 33. Thus, respective frames of image signals are displayed on liquid crystal panel 34 in sequence.

Backlight device 35 is disposed on the back side of liquid crystal panel 34. A direct-type backlight device and/or a light-guiding plate type backlight device may be used as backlight device 35. The direct-type backlight device is disposed directly below liquid crystal panel 34. In the case for the light-guiding plate type backlight device, light emitted from a backlight is made incident onto a light-guiding plate so as to irradiate liquid crystal panel 34. Backlight device 35 is driven by backlight driver 36. To backlight driver 36, power is supplied from power source 40 to cause the backlight to emit light. Incidentally, power source 40 supplies power to circuits which need power. Liquid module unit 30 includes temperature sensor 37, which detects the temperature of backlight device 35, and color sensor 38, which detects the color temperature of light emitted from backlight device 35.

A specific configuration example of backlight device 35 next is described. FIG. 4 is a view showing an embodiment wherein backlight device 35 is divided into four regions along the longitudinal to vertical directions. Hereinafter, a first configuration example of backlight device 35 shown in FIG. 4 is referred to as backlight device 35A, and a second configuration example of backlight device 35 shown in FIG. 5 is referred to as backlight device 35B as will be described later. Backlight device 35 is a collective term for backlight device 35A, backlight device 35B and other configuration. FIG. 4A is a top view of backlight device 35A, and FIG. 4B is a sectional view showing a state in which backlight device 35A is vertically cut.

Figure 4B:
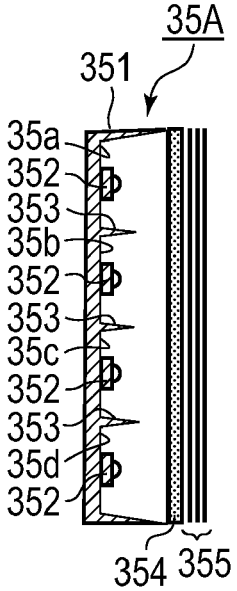
FIGS. 4A and 4B show a first configuration example of backlight device 35.
Figure 4A:
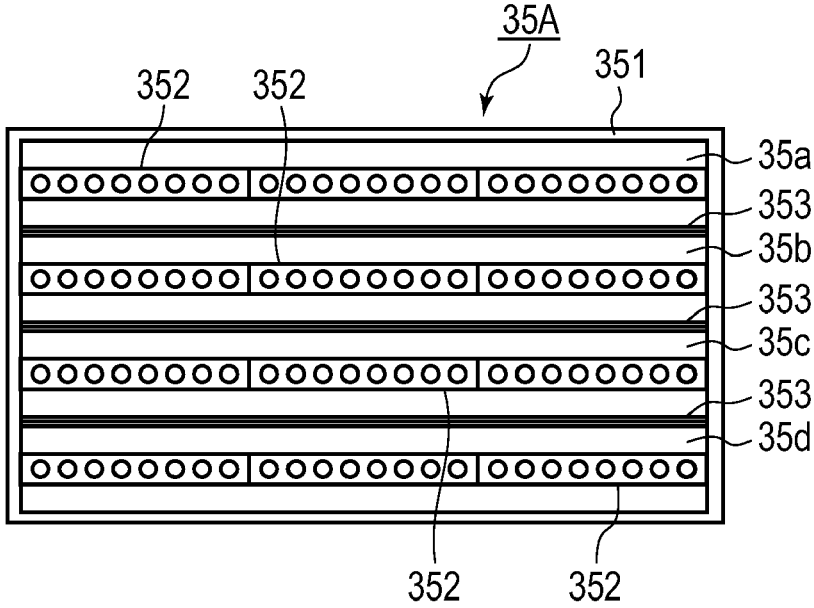

As shown in FIGS. 4A and 4B, backlight device 35A has a configuration in which light source 352 for the backlight is horizontally arranged in and attached to rectangular housing 351 having a predetermined depth. Light source 352 is, for example, an LED. Backlight device 35A is divided into regions 35*a* to 35*d* with partition walls 353. Partition walls 353 protrude from the bottom surface of housing 351 to the predetermined portion higher than the uppermost surface (vertexes) of light sources 352. Inner sides of housing 351 and surfaces of partition wall 353 are covered with reflective sheets.

Diffusion plate 354 diffusing light is mounted on an upper part of housing 351. Three optical sheets and their like 355 are mounted on diffusion plate 354 for example. Optical sheets and their like 355 are formed by combining multiple sheets such as a diffusion sheet, a prism sheet, and a brightness enhancement film, which is referred to as a DBEF (Dual Brightness Enhancement Film). Each top surface of partition walls 353, covered with reflective sheet, does not reach diffusion plate 354, so that regions 35*a* to 35*d* are not separated, and are not completely independent from each other. That is, backlight device 35A has a structure in which light emission from each light source 352 of regions 35*a* to 35*d* is allowed to leak to other regions. As described later, in the first embodiment, the amount of light leaked from regions 35*a* to 35*d* to other regions is considered, allowing control of the luminances of the lights emitted from regions 35*a* to 35*d*.

FIG. 5 is a view showing backlight device 35B, which is a second configuration example of backlight device 35 in the case where liquid crystal panel 34 is divided into four regions in the vertical direction and, further, divided into four regions in the horizontal direction, i.e., in the case where liquid crystal panel 34 is divided into sixteen regions in two dimension. FIG. 5A is a top view of backlight device 35B; FIG. 5B is a sectional view showing backlight device 35B cut in the vertical direction. FIG. 5C is a sectional view showing backlight device 35B cut in the horizontal direction. Here, FIG. 5B shows backlight device 35B cut along the left-end partition wall in FIG. 5A. FIG. 5C shows backlight device 35B cut along the top-end partition wall in FIG. 5A.

In FIGS. 4A to 4B, and FIGS. 5A to 5C, identical reference numerals indicate identical components, so that a description thereof will be omitted as appropriate.

Housing 351 is divided into sixteen regions, regions 35*a*1 to 35*a*4, 35*b*1 to 35*b*4, 35*c*1 to 35*c*4, and 35*d*1 to 35*d*4, with partition walls 353 in the horizontal and vertical directions. Backlight device 35B has a structure in which light emits from each of light sources 352 in regions 35*a*1 to 35*a*4, 35*b*1 to 35*b*4, 35*c*1 to 35*c*4, and 35*d*1 to 35*d*4 and is allowed to leak to other regions. In the first embodiment, the amount of light leakage from respective regions 35*a*1 to 35*a*4, 35*b*1 to 35*b*4, 35*c*1 to 35*c*4, and 35*d*1 to 35*d*4 to other regions is considered so that luminances of light from regions 35*a*1 to 35*a*4, 35*b*1 to 35*b*4, 35*c*1 to 35*c*4, and 35*d*1 to 35*d*4 are controlled.

A LED is a highly directional light source. Accordingly, when a LED is used for light source 352, the heights of partition walls 353 covered with reflective sheets may be lower than that shown in FIGS. 4 and 5, and may be removed depending on the situation. Dome-like lenses may cover elements of light sources 352 so that the same effects can occur as that caused by partition walls 353. Further, light sources other than LEDs, such as CCFLs and external electrode fluorescent lamps (EEFLs) may be used as light sources for the backlight. However, an LED is still preferable as light source 352 in the first embodiment since it is easy to control light emission luminance and the light emitting area thereof. The specific configuration of backlight device 35 is not limited to those shown in FIGS. 4 and 5.

Figure 6A:
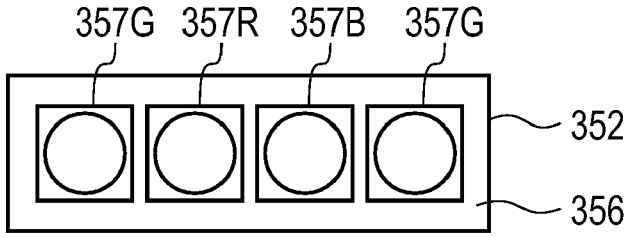
FIGS. 6A to 6D are plan views showing configuration examples of light source 352 of backlight device 35.
Figure 6B:
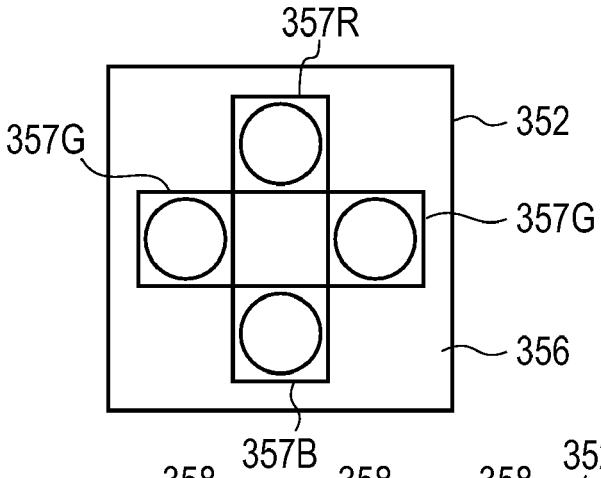

More specifically, light sources 352 shown in FIGS. 4 and 5 are configured as follows. In a first configuration example light sources 352 shown in FIG. 6A, LED 357G of G, LED 357R of R, LED 357B of B, and LED 357G of G are mounted on substrate 356 in this order. Substrate 356 is, for example, an aluminum substrate or an epoxy substrate. Each of light sources 352, shown in FIGS. 4 and 5, is configured by aligning multiple light sources 352 of FIG. 6A. In a second configuration example of light sources 352 shown in FIG. 6B, LED 357R of R, LED 357G of G, LED 357B of B, and LED 357G of G are mounted on substrate 356 in a rhombic shape. Each of light sources 352, shown in FIGS. 4 and 5, is configured by aligning multiple light sources 352 of FIG. 6B.

Figure 6C:
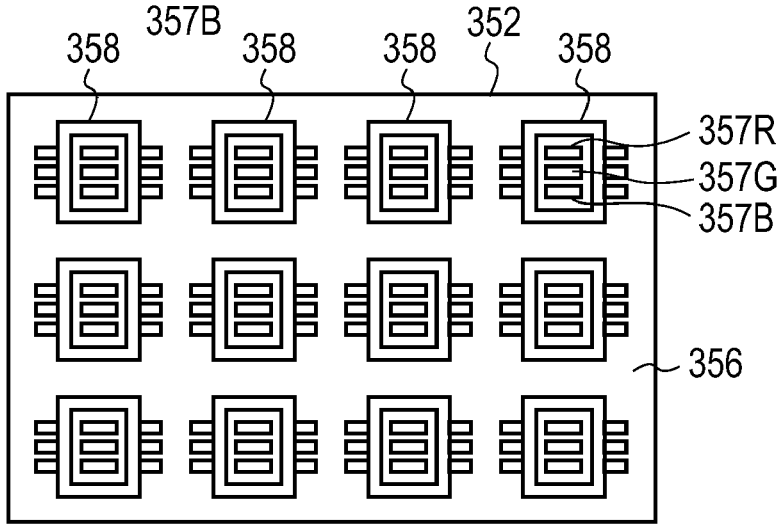
Figure 6D:
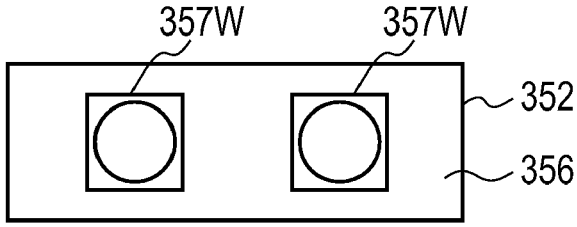

In a third configuration example of light source 352 shown in FIG. 6C, twelve LED chips, each portion of which integrally includes LED 357R of R, LED 357G of G, and LED 357B of B, are mounted on substrate 356. Each of light sources 352, shown in FIGS. 4 and 5, is configured by aligning multiple light sources 352 of FIG. 6C. In a fourth configuration example of light source 352 shown in FIG. 6D, two LED 357Ws of white (W) are mounted on substrate 356. Each of light sources 352, shown in FIGS. 4 and 5, is configured by aligning multiple light sources 352 of FIG. 6D. Further, LED 357Ws are in two types, one in which a yellow fluorescent substance is excited by a light irradiated from an LED of B to generate white light, and a second in which fluorescent substances of R, G, and B are exited by ultraviolet rays irradiated from an LED to generate white light. Any of the above two types can be employed.

Returning back to FIG. 1, a configuration and operation of backlight luminance controller 20 will be described. Besides non-uniformization processor 21, backlight luminance controller 20 includes light emission luminance calculator 22, white balance adjustor 23, and PWM timing generator 24. For simplicity sake, backlight device 35 will be described as backlight device 35A shown in FIG. 4. Taking the maximum luminance of a backlight as Bmax, the light emission luminance of each of backlight regions 35*a* to 35*d* of backlight device 35 may be obtained by multiplying Gmax1/Gmax0, which is obtained for each of regions 34*a* to 34*d*, by maximum luminance Bmax. In this way, non-uniformization processor 21 obtains luminances $B_1$ to $B_4$ that the backlights of regions 35*a* to 35*d* are expected to emit.

Calculated light emission luminances $B_1$ to $B_4$ are not for the light right above light sources 352 when the backlight light sources emit light, but are from lights emitted from backlight device 35 itself. That is, in the configuration examples of FIGS. 4 and 5, light emission luminances $B_1$ to $B_4$ are over optical sheets or the like 355. Incidentally, the calculated light emission luminance from a light that is expected to emit from one region of backlight device 35 is collectively referred to as B. In the following description, it is assumed that luminance distributions of light emitted from regions 35*a* to 35*d* of the backlight device are uniform within each region. However, in some case the luminance distribution is not uniform in one region. Such case, luminance at any arbitrary point within one region may be any of light emission luminances $B_1$ to $B_4$.

When gradations of all the image signals on regions 34*a* to 34*d* are the same, all the light emission luminances $B_1$ to $B_4$ of regions 35*a* to 35*d* have heretofore been the same. That is, calculated light emission luminances $B_1$ to $B_4$ are set as real light emission luminances. Meanwhile, in the first embodiment, non-uniformization processor 21 multiplies the calculated light emission luminances $B_1$ to $B_4$ by non-uniformization coefficients $p_1$ to p4 so that the light emission luminances of lights really emitted from the regions 35*a* to 35*d* are set as $p_1B_1$, $p_2B_2$, $p_3B_3$, and $p_4B_4$. Each of coefficients $p_1$ to $p_4$ is greater than 0, and equal to 1 or less.

The inventors have found the following relationship between the quality of images displayed on liquid crystal panel 34 and the conditions where the backlights emit. Specifically, the image quality is higher when the backlights emit lights with slightly lower light emission luminances than calculated ones, along a periphery of the screen of liquid crystal panel 34.

Therefore, in the example of FIG. 4 in which the region of backlight device 35 is divided along one dimension into four sub-regions, it is preferable to set different light emission luminances for each of the lights emitting from 4 regions. Specifically, light emission luminances $B_1$ and $B_4$ from regions 35*a* and 35*d* equivalent to upper and lower parts of the screen may be set lower than those $B_2$ and $B_3$ from regions 35*b* and 35*c*. More specifically, as an example, $p_1$ is set to 0.8; $p_2$ and $p_3$ are set to 1; and $p_4$ is set to 0.8.

When the luminances of regions 34*b* and 34*c* of liquid crystal panel 34 are 500 [cd/m$^2$] in an all white state in which liquid crystal panel 34 entirely displays a white color, each luminance of regions 34*a* and 34*d* is set to 400 [cd/m$^2$]. Accordingly, the power consumption of regions 35*a* and 35*d* can be reduced by 20%. Therefore, in the first embodiment, non-uniformization processor 21 allow reduction of power consumption by backlight device 35, while rather enhancing the quality of images displayed on liquid crystal panel 34, and not degrading the quality thereof. When considering both the quality of images and the power consumption, it is preferable that the coefficients $p_1$ to $p_4$ be set to 0.8 to 1.0. That is, the coefficient p to be multiplied to each light emission luminance of backlights at a screen center is set to 1.0, and that to each light emission luminance at a periphery of the screen is set to a value in a range having a lower bound of 0.8.

Further, the non-uniformization coefficient p in the case where liquid crystal panel 34 and backlight device 35 are divided into regions in two dimensions will be described. As exemplified here, liquid crystal panel 34 and backlight device 35 are divided into eight regions horizontally and vertically respectively, i.e., they are divided in two dimensions into sixty-four regions. In this case, as shown in FIG. 7, backlight device 35 has regions 35*a*1 to 35*a*8, 35*b*1 to 35*b*8, 35*c*1 to 35*c*8, 35*d*1 to 35*d*8, 35*e*1 to 35*e*8, 35*f*1 to 35*f*8, 35*g*1 to 35*g*8, and 35*h*1 to 35*h*8. Although not shown particularly, liquid crystal panel 34 is partitioned into sixty-four regions that correspond to the sixty-four regions of backlight device 35.

Figure 8A:
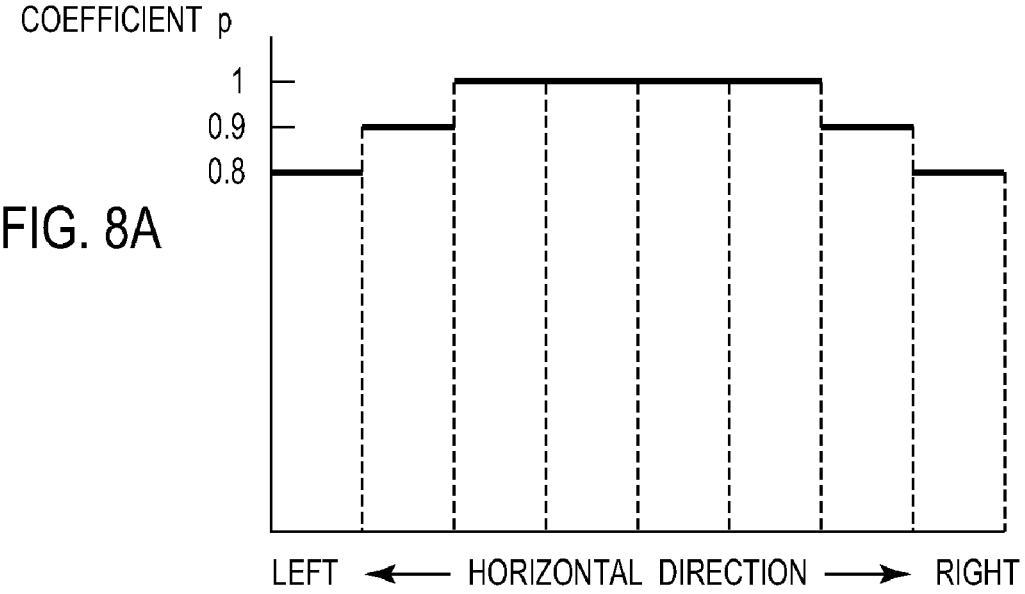
FIGS. 8A and 8B are graphs for describing a non-uniformization process in non-uniformization processor 21 shown in FIG. 1.

FIG. 8A illustrates an example wherein coefficient p is multiplied to each of calculated light emission luminances of respective regions 35*c*1 to 35*c*8, 35*d*1 to 35*d*8, 35*e*1 to 35*e*8, 35*f*1 to 35*f*8, which correspond to four rows of the backlight device 35 in the central part thereof in the vertical direction and wherein each indicate eight regions in the horizontal direction. In FIG. 8A, the left and right directions show regions of the screen of liquid crystal panel 34 in the horizontal direction. The left-hand side corresponds to the left end of the screen, and the right-hand side corresponds to the right end thereof. In this example, for four regions that are horizontally centered, coefficient p is set to 1; regions on the left and right sides are set to 0.9; and regions on the left and right ends are set to 0.8.

Preferably coefficient p is set to decrease gradually in sequence from the central part, where the coefficient p is 1, to the left and right ends. At this time, it is preferable that coefficient p be laterally symmetric with respect to the middle in the horizontal direction. Here, coefficient p has been set to 1 for the central four regions. However, coefficient p may be set so that the coefficient p takes the value of 1 for the central two regions. Here, coefficient p decreases in sequence from a value less than 1, to 0.8, for regions from the left and right sides of these two regions towards the left and right ends. In addition, when each of the rows is divided into an odd number in the horizontal direction, a region may have a coefficient p of 1. Characteristics of coefficient p in the horizontal direction may be further adjusted to provide the most favorable image quality on a real screen.

Figure 8B:
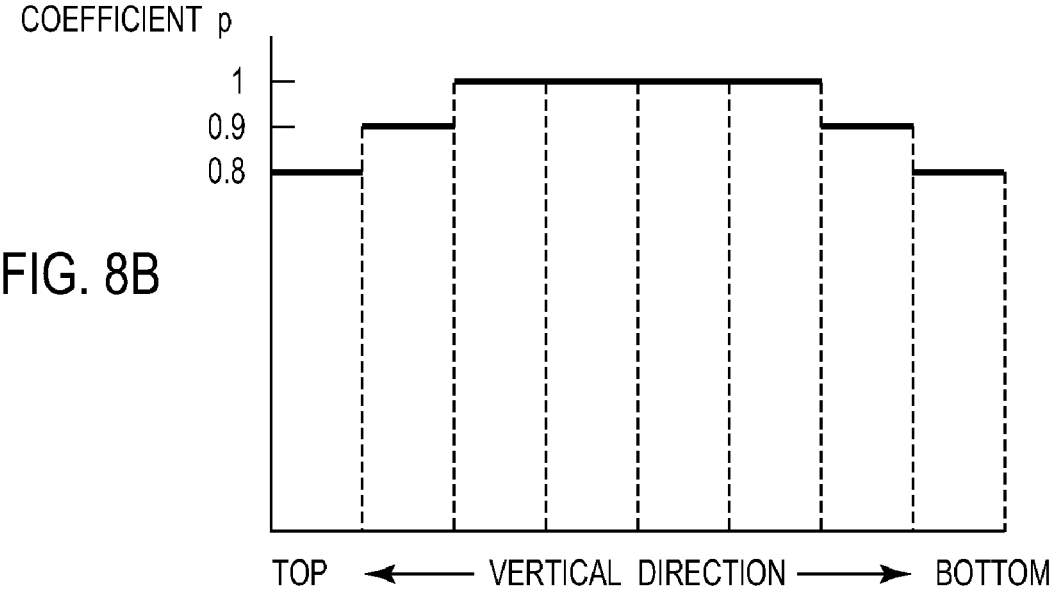

FIG. 8B is a view showing an example of a coefficient p that is multiplied to calculate each light emission luminance of respective regions 35*a*3 to 35*h*3, 35*a*4 to 35*h*4, 35*a*5 to 35*h*5, and 35*a*6 to 35*h*6, which correspond to four columns of the backlight device 35 in the central part thereof in the horizontal direction and which each indicate eight regions in the vertical direction. In FIG. 8B, the left and right directions show the vertical direction of the screen of liquid crystal panel 34. The left-hand side corresponds to an upper end of the screen, and the right-hand side corresponds to a lower end thereof. In this example, for four vertically centered regions, coefficient p is set to 1. In this case, regions on the upper and lower sides thereof are set to 0.9; and regions on the upper and lower ends are set to 0.8.

Also in the vertical direction, it is preferable that coefficient p be set to decrease gradually in sequence from the central part, where the coefficient p is 1, to the upper and lower ends. At this time, it is preferable that coefficient p be symmetric with respect to the middle in the vertical direction toward the upper and lower ends. Here, coefficient p has been set to 1 for the central four regions. However, coefficient p may be set to take the value of 1 for the central two regions. In this instance, coefficient p decreases in sequence from a value less than 1, to 0.8 for regions from the upper and lower sides of these two regions toward the upper and lower ends. In addition, when each of the columns is divided into an odd number in the vertical direction, one region may have a coefficient p of 1. Characteristics of the coefficient p in the vertical direction may be adjusted to provide a most favorable image quality on a real screen. Incidentally, the characteristics of coefficient p in the horizontal and vertical directions may differ from each other.

As described above, data are obtained from non-uniformization processor 21 that indicate light emission luminances of lights that are actually expected from respective regions of backlight device 35. Controller 50 supplies coefficient p for use in non-uniformization processor 21. Controller 50 can be configured by a microcomputer, and coefficient p can be arbitrarily varied. Data that indicate each light emission luminance is inputted into light emission luminance calculator 22, and the luminance of light that each light source 352 is expected to emit is calculated as follows. A calculation method of luminance of light that each of light sources 352 is expected to emit will be described, in the case where backlight device 35 represents backlight device 35A having regions 35*a* to 35*d*. Light emission luminances of lights to be actually emitted from regions 35*a* to 35*d* are represented by $p_1B_1$, $p_2B_2$, $p_3B_3$, and $p_4B_4$ respectively.

FIG. 9A shows a sectional view of FIG. 4B in a laid flat position. Here, optical sheets or their like 355 are omitted. Light emissions from regions 35*a* to 35*d* are represented by $p_1B_1$, $p_2B_2$, $p_3B_3$, and $p_4B_4$ respectively, and are denoted: $p_1B_1=B_1'$, $p_2B_2=B_2'$, $p_3B_3=B_3'$, and $p_4B_4=B_4'$. B' with "'" represents a light emission luminance value on which a non-uniformization process is performed by non-uniformization processor 21, while B without "'" represents a light emission luminance value on which a non-uniformization process is not performed. In addition, $B_{o1}$, $B_{o2}$, $B_{o3}$, and $B_{o4}$ represent luminances directly above light sources 352 of regions 35*a* to 35*d* respectively, assuming that each light source 352 emits a light individually. As described previously, backlight device 35 has a structure wherein light that emits from each of light sources 352 of regions 35*a* to 35*d* is allowed to leak to other regions, so that the light emission luminances $B_1'$, $B_2'$, $B_3'$, and $B_4'$ and the light emission luminances $Bo_1$, $Bo_2$, $Bo_3$, and $B_{o4}$ are respectively not identical. Incidentally, the small light attenuation due to the presence of diffusion plate 354 and optical sheets or their like 355 can be ignored. In addition, the light emission luminance directly above light sources 352 when light source 352 on one region of backlight device 35 individually emits a light collectively are referred to as $B_o$.

As shown in FIG. 9A, when all light sources 352 of respective regions 35*a* to 35*d* emit lights, each light from corresponding light sources 352 leaks to adjacent regions, while showing up as light leakage $L_1$ with a the light emission luminance that is k multiplied by a corresponding $Bo_1$, $Bo_2$, $Bo_3$, or $Bo_4$. Here, k represents an attenuation coefficient when light leaks. The value of k is greater than 0 and less than 1. Further, the leakage light emission from a corresponding light source 352 and which leaks out the region thereof to other regions, is examined. FIG. 9B shows a state in which only light source 352 on region 35*a* emits a light. The light emitted therefrom leaks to other regions 35*b* to 35*d*. Light emitted from light source 352 onto region 35*a* at light emission luminance $B_{o1}$ leaks to region 35*b* while represented as leakage light $L_2$ having a luminance of $kBo_1$. The leakage light $L_1$ having a luminance of $kBo_1$, further, becomes leakage light $L_2$ having a luminance of $k^2Bo_1$, which is k times luminance $kB_{o1}$, and leaks to region 35*c*. Leakage light $L_2$ having a luminance of $k^2Bo_1$, further, becomes leakage light $L_3$ having a luminance of $k^3Bo_1$, which is k times luminance $k^2Bo_1$, and leaks to region 35*d*.

In FIG. 9B, light having a light emission luminance of approximately $Bo_1$ is emitted from region 35*a*. A light is emitted from region 35*b* with the leakage light $L_1$ having a light emission luminance of $kBo_1$ as a light source thereof. A light is emitted from region 35*c* with the leakage light $L_2$ having a light emission luminance of $k^2Bo_1$ as a light source thereof, and a light is emitted from region 35*d* with the leakage light $L_3$ having a light emission luminance of $k^3Bo_1$ as a light source thereof.

Figure 10:
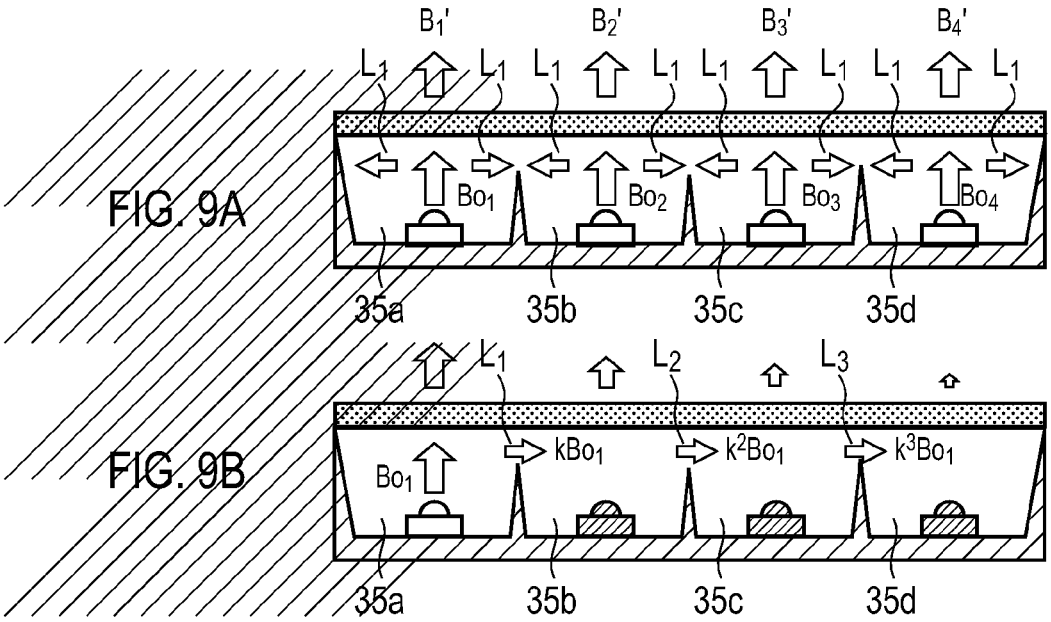

FIG. 10 is a table showing luminances of lights emitted from regions 35*a* to 35*d* the time when each of light sources 352 of regions 35*a* to 35*d* is individually turned on. Luminances of lights emitted from respective regions 35*a* to 35*d* at the time when all light sources 352 of regions 35*a* to 35*d* are turned on are summed luminances in the vertical direction as shown in Table of FIG. 10. That is, the luminance of a light emitted from region 35*a* is given by $Bo_1+kBo_2+k^2Bo_3+k^3Bo_4$, and that emitted from region 35*b* is given by $kBo_1+Bo_2+kBo_3+k^2Bo_4$. The luminance of a light emitted from region 35*c* is given by $k^2Bo_1+kBo_2+Bo_3+kBo_4$, and that emitted from region 35*d* is given by $k^3Bo_1+k^2Bo_2+kBo_3+Bo_4$. Since each emission luminance of light emitted from regions 35*a* to 35*d* is represented by $B_1'$ to $B_4'$ respectively, it can be seen that $B_1'$ is given by $Bo_1+kBo_2+k^2Bo_3+k^3Bo_4$ for region 35*a*, $B_2'$ by $kBo_1+Bo_2+kBo_3+k^2Bo_4$ for region 35*b*, $B_3'$ by $k^2Bo_1+kBo_2+Bo_3+kBo_4$ for region 35*b*, and $B_4'$ by $k^3Bo_1+k^2Bo_2+kBo_3+Bo_4$ for region 35*b*.

Eq. (1) shown in FIG. 11A represents a matrix equation which more specifically is a conversion equation for obtaining light emission luminances $B_1'$, $B_2'$, $B_3'$, and $B_4'$ from light emission luminances $Bo_1'$, $Bo_2'$, $Bo_3'$, and $Bo_4'$ emitted from light sources 352. Eq. (2) shown in FIG. 11B represents a matrix equation which more specifically is a conversion equation for obtaining the light emission luminances $Bo_1'$, $Bo_2'$, $Bo_3'$, and $Bo_4'$ from the light emission luminances $B_1'$, $B_2'$, $B_3'$, and $B_4'$. Eq. (3) shown in FIG. 11C is obtained by rearranging Eq. (2) to make it easy to perform a calculation in a circuit of the light emission luminance calculator 22. Eq. (4) shown in FIG. 11D shows constants a, b, and c of Eq. (3). As seen in Eq. (3) of FIG. 11C, each light emission luminance $Bo_1$, $Bo_2$, $Bo_3$, and $Bo_4$ can be obtained by multiplying each light emission luminance $B_1'$, $B_2'$, $B_3'$, and $B_4'$ by coefficients (conversion coefficients) based on amounts of light, emitted from each light source 352 of regions 35*a* to 35*d*, which leak out of these region to other regions.

Since the leakage light $L_1$ from one region of backlight device 35 to adjacent regions can be measured, the value of the attenuation coefficient k described in FIGS. 9 and 10 can be determined in advance. Thus, based on Eq. (3) of FIG. 11C and Eq. (4) of FIG. 11D, each of the light emission luminances $Bo_1$, $Bo_2$, $Bo_3$, and $Bo_4$ of lights that each of light sources 352 of regions 35*a* to 35*d* is expected to emit can be accurately calculated.

Incidentally, when the attenuation coefficient k of leakage light into adjacent regions is small, a term with k to the power of two or greater becomes negligibly small. In this case, each of the light emission luminances may be approximated by assuming that light emitted from one region leaks to adjacent regions only. That is, the calculation may be performed by zeroing out a term that has k to the power of 2 or greater. In addition, according to the structure of backlight device 35, light emitted from one region may be attenuated not in the form of $k^2$ times, . . . , $k^n$ times (here, n=3), but each leakage light to other regions can be measured in advance so that, in this case also, each expected light emission luminance $Bo_1$, $Bo_2$, $Bo_3$, and $Bo_4$ that corresponds to light source 352 can be accurately calculated. The same applies to the cases of FIGS. 5 and 7, with the different ways of region divisions shown in these figures.

When backlight device 35 is divided into eight regions in the vertical direction, each light emission luminance of light emitted from each region is represented by $B_1'$ to $B_8'$ respectively, and each light emission luminance of light directly above the corresponding light source 352 is represented by $B_1$ to $B_8$, assuming that each light source 352 emits light individually. The light emission luminances $Bo_1$ to $Bo_8$ can be calculated by Eq. (5) as shown in FIG. 12. Further, generalizing the above, i.e., when backlight device 35 is divided into n regions in the vertical direction (n: a positive integer being equal to 2 or greater), light emission luminances $B_1'$ to $B_n'$ are obtained by Eq. (6) shown in FIG. 13A, and light emission luminances $Bo_1$ to $Bo_n$ can be calculated using Eq. (7) shown in FIG. 13B.

Figure 14:
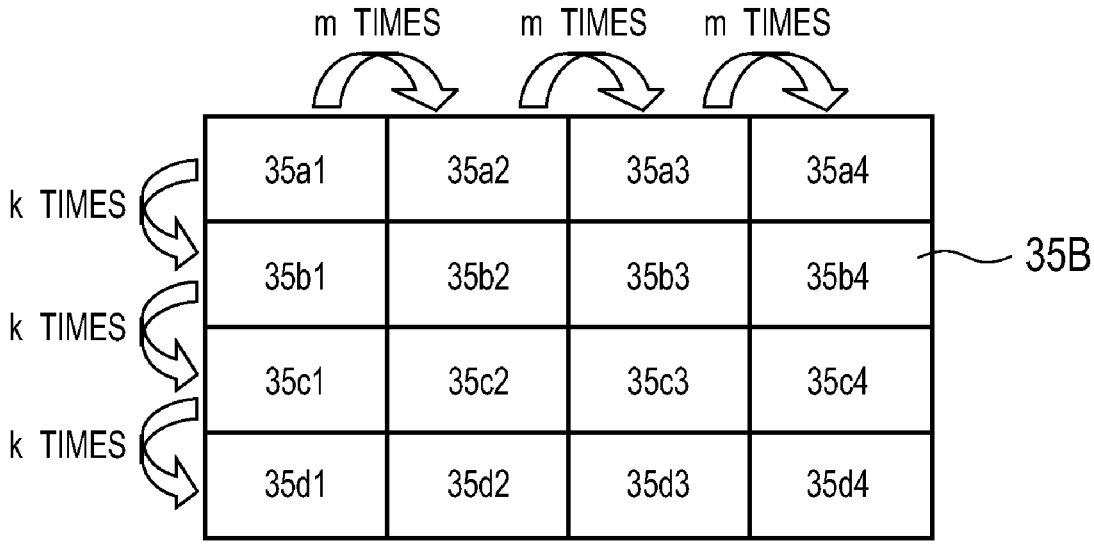
FIG. 14 is a diagram for describing leakage lights when the backlight device 35 is region-divided in two dimensions.

Next, a calculation method of light luminance from each light sources 352 will be described wherein backlight device 35 corresponds to backlight device 35B shown in FIG. 5. As shown in FIG. 14, each leakage light, leaked from light source 352 onto regions 35*a*1 to 35*a*4, 35*b*1 to 35*b*4, 35*c*1 to 35*c*4, and 35*d*1 to 35*d*4 of backlight device 35B to adjacent regions in the horizontal direction, is assumed to be larger than the light emitted from each of light sources 352 by m times. An attenuation coefficient m in the horizontal direction is between 0 and 1. The emission of light that leaks to adjacent regions in the vertical direction is k times the light emitted from each of light sources 352 as in the case of backlight device 35A. Each light emission luminance for lights that correspond to regions 35*a*1 to 35*a*4, 35*b*1 to 35*b*4, 35*c*1 to 35*c*4, and 35*d*1 to 35*d*4 of backlight device 35B that are expected to actually emit is represented by $B_{11}'$ to $B_{14}'$, $B_{21}'$ to $B_{24}'$, $B_{31}'$ to $B_{34}'$, and $B_{41}'$ to $B_{44}'$ respectively. To obtain each light emission luminance $B_{11}'$ to $B_{14}'$, $B_{21}'$ to $B_{24}'$, $B_{31}'$ to $B_{34}'$, and $B_{41}'$ to $B_{44}'$, each expected light emission luminance of light sources 352 onto their respective regions is represented by $Bo_{11}$ to $Bo_{14}$, $Bo_{21}$ to $Bo_{24}$, $Bo_{31}$ to $Bo_{34}$, and $Bo_{41}$ to $Bo_{44}$ respectively.

When applying the calculation method described in FIGS. 9 and 10 in which leakage lights are considered, to that in the horizontal direction, a matrix equation shown in FIG. 15 is obtained. Eq. (8) shown in FIG. 15A is a conversion equation given by a matrix equation for obtaining the light emission luminances $B_{11}'$ to $B_{44}'$ from the light emission luminances $Bo_{11}$ to $Bo_{44}$ of lights that light sources 352 emit. Eq. (9) shown in FIG. 15B is a conversion equation given by a matrix equation for obtaining the light emission luminances $Bo_{11}$ to $Bo_{44}$ from the light emission luminances $B_{11}'$ to $B_{44}'$. By rearranging Eq. (9), Eq. (10) shown in FIG. 15C is obtained. Eq. (11) shown in FIG. 15D shows constants a, b, c, d, e, and f of Eq. (10). Also, as seen in FIG. 14, since the values of attenuation coefficients k and m can be obtained in advance, the light emission luminances $Bo_{11}$ to $Bo_{44}$ of lights that respective light sources 352 of regions 35*a*1 to 35*d*4 are expected to emit can be accurately calculated based on Eq. (10) of FIG. 15C and Eq. (11) of FIG. 15D.

When backlight device 35 is divided into eight regions in both the horizontal and vertical directions, each of light emission luminances that the sixty-four regions are expected to emit is represented by $B_{11}'$ to $B_{88}'$ respectively. Also, each light emission luminance of light directly above the corresponding light sources 352 is represented by $Bo_{11}$ to $Bo_{88}$, assuming that each light source 352 emits a light individually. The light emission luminances $B_{11}'$ to $B_{88}'$ are obtained by Eq. (12) shown in FIG. 16A, and the light emission luminances $Bo_{11}$ to $Bo_{88}$ can be calculated by Eq. (13) shown in FIG. 16B. Further, generalizing the above, backlight device 35 as an example, is divided into n regions in both the horizontal and vertical directions (n: a positive integer being equal to 2 or greater) and light emission luminances $Bo_{11}$ to $Bo_{n,n}$ can be calculated by Eq. (14) shown in FIG. 17 using light emission luminances $B_{11}'$ to $B_{n,n}'$. Although not shown in the drawing, even when backlight device 35 is divided into nh regions (nh: a positive integer being equal to 2 or greater) in the horizontal direction, and further divided into nv regions (nv: a positive integer being equal to 2 or greater, not being the same value as nh) in the vertical direction, a matrix equation will be used as in the above case so that light emission luminances of lights that respective light sources 352 are expected to emit can be accurately calculated.

Returning to FIG. 1, the attenuation coefficients k and m for light emission luminance calculator 22 are supplied from controller 50. The attenuation coefficients k and m can be varied arbitrarily. Data thus obtained, which indicate light emission luminances of lights that respective light sources 352 on multiple regions of backlight device 35 emit, are supplied to white balance adjustor 23. Temperature data indicative of a temperature of backlight device 35, and color temperature data indicative of a color temperature of a light emitted from backlight device 35 are inputted to white balance adjustor 23. The temperature data described above are outputted from temperature sensor 37, while color temperature data described above are outputted from color sensor 38.

As described above, the luminance of a light emitted from an LED (an LED for R in particular) changes according to the change of the temperature of backlight device 35. Therefore, when light sources 352 include LEDs of three colors, white balance adjustor 23 adjusts the amount of light of LEDs of R, G, and B based on the temperature data and the color temperature data so that a white balance can be adjusted to optimum. Incidentally, the white balance of backlight device 35 can also be adjusted using an external control signal $S_{ct1}$ supplied from controller 50. In addition, when a change, caused by temperature change or variation with time, in the white balance of backlights is small, white balance adjuster 23 can be eliminated.

Data outputted from white balance adjuster 23 are supplied to PWM timing generator 24. The data indicate the luminances of lights from respective sources 352 onto multiple regions of backlight device 35, are supplied to white balance adjustor 23. When each light source 352 is an LED, the light emission of an LED of each color is controlled using, for example, a pulse duration modulation signal. PWM timing generator 24 supplies backlight driver 36 with PWM timing data, which includes timing for the pulse duration modulation signal, and pulse duration for adjusting the amount of light emission (light emission time). Backlight driver 36 generates a drive signal as a pulse duration modulation signal based on the PWM timing data thus inputted, and drives the light sources (LEDs) of backlight device 35.

The above description is an example wherein each LED is driven by the pulse duration modulation signal. However, it is also possible to control each of the light emission luminances of the LEDs by adjusting the current flowing through the LEDs. In this case, instead of PWM timing generator 24, a timing generator may be provided that generates timing data for determining when current flows through the LEDs, and the value of the current. In addition, for non-LED light sources, the light emission may be controlled differently, according to the type of light source, and a timing generator generating timing data according to the kind of light sources may be provided. In FIG. 1, although backlight luminance controller 20 and controller 50 are separately provided, all or part of the backlight luminance controller 20 circuits can be provided in controller 50. Further, in the configuration of FIG. 1, for example, the maximum gradation detector 11, image gain calculation unit 12, and backlight luminance controller 20 may be configured in hardware, software, or combinations thereof. Without having to repeat the description, i.e., the description on a synchronization in which the displaying of respective frames of image signals on liquid crystal panel 34, the image signals being outputted from image signal processor 10, and the controlling of backlight luminances by backlight luminance controller 20 according to a maximum luminance of image signals are synchronized with each other. In FIG. 1, the drawing of a configuration on the synchronizing of both described above has been omitted.

Figure 18:
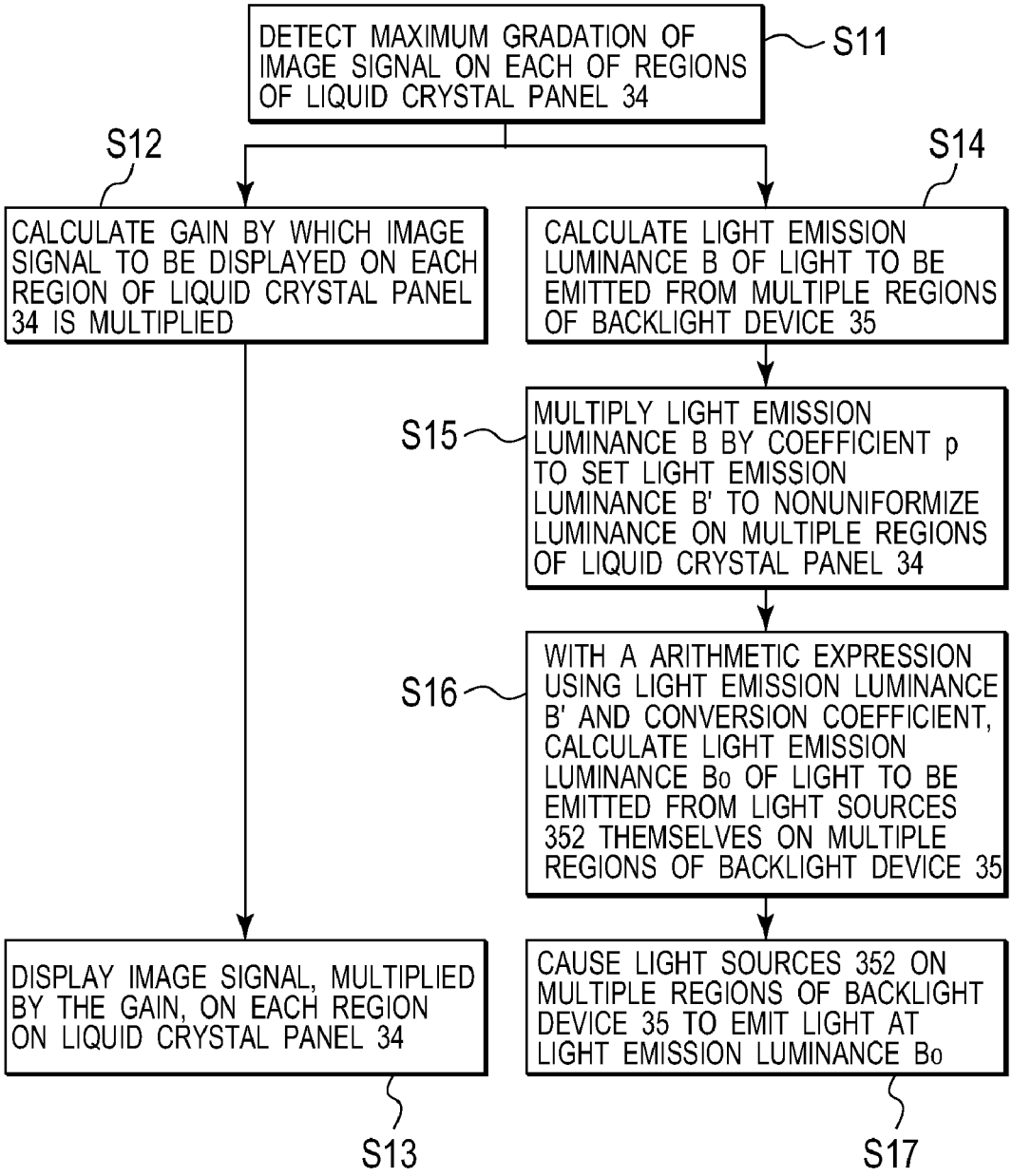
FIG. 18 is a flowchart showing the operation of the liquid crystal display device and a procedure of the image display method according to the first embodiment.

Referring to FIG. 18, further described is the foregoing operation of the liquid crystal display device shown in FIG. 1, and a procedure of performing the foregoing image display in the liquid crystal display device. In FIG. 18, (Step S11), maximum gradation detector 11 detects a maximum gradation of an image signal for each region of liquid crystal panel 34. In Step S12, image gain calculator 12 calculates a gain, which is multiplied to image signals for display on respective regions of liquid crystal panel 34. In Step S13, liquid module unit 30 displays the image signals of the respective regions multiplied by the gain. Steps S14 to S17 are performed in parallel with Steps S12 and S13.

In Step S14, non-uniformization processor 21 obtains light emission luminances B of lights that are expected from multiple regions of backlight device 35, and multiplies the light emission luminances B by a coefficient p (to be thereafter set as light emission luminances B') so that the luminances of the multiple regions of liquid crystal panel 34 are made non-uniform. In Step S16, light emission luminance calculator 22 obtains light emission luminances Bo of lights to be emitted from light sources 352 themselves on multiple regions of backlight device 35, using a calculation equation using the light emission luminance B' and a conversion coefficient. Further, in Step S17, PWM timing generator 24 and backlight driver 36 causes light sources 352 on multiple regions of backlight device 35 to emit as light emission luminance Bo with synchronization established with Step S13.

In the configuration shown in FIG. 1, non-uniformization processor 21 obtains light emission luminances B' on which a non-uniformization process is performed, and light emission luminance calculator 22 obtains light emission luminances Bo based on this light emission luminances B'. However, a non-uniformization process may be performed after obtaining the light emission luminance Bo using light emission luminance calculator 22. That is, non-uniformization processor 21 and light emission luminance calculator 22 may be interchanged. Such operation and a procedure for this will be described in refer to FIG. 19.

Figure 19:
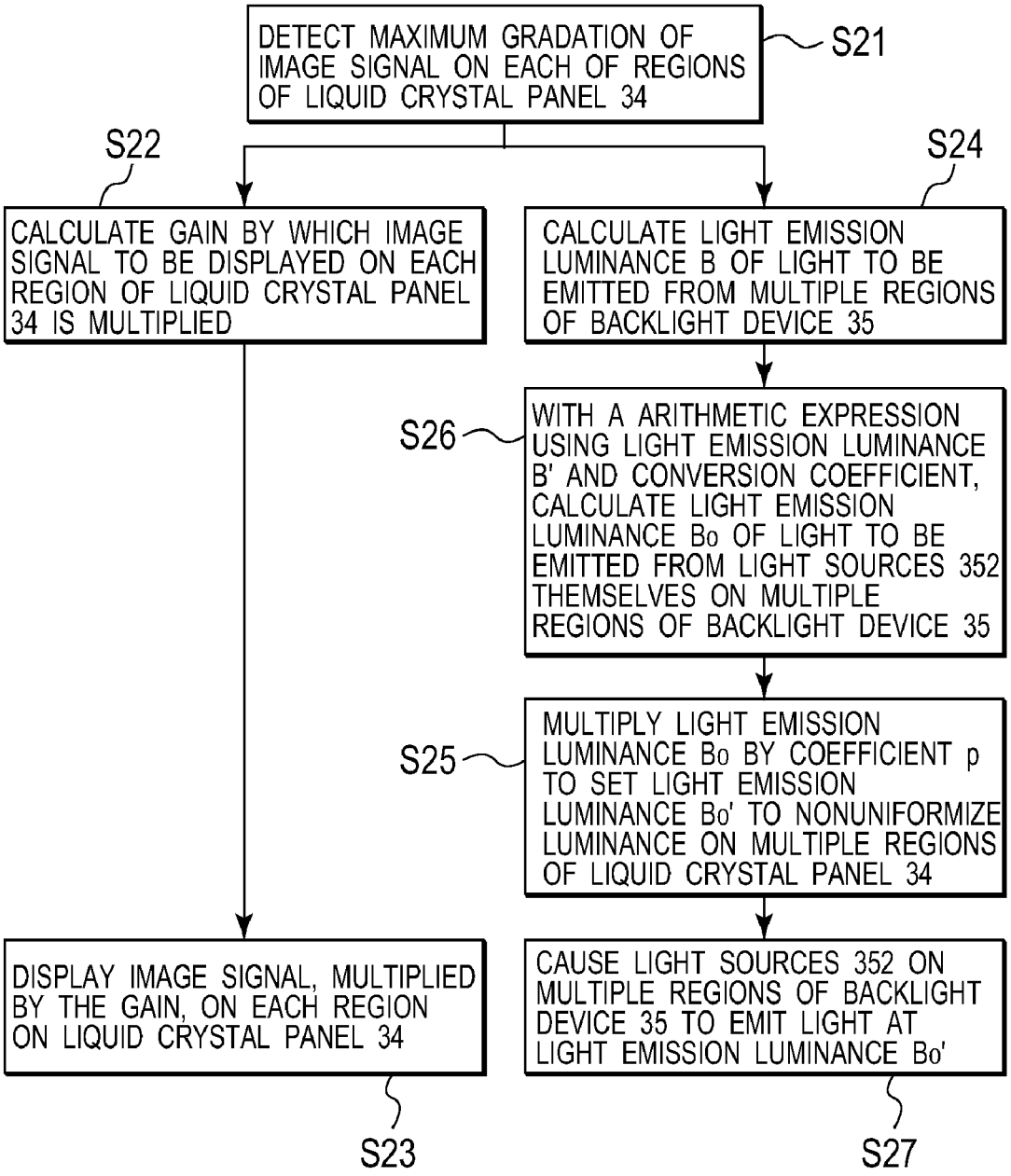
FIG. 19 is a flowchart showing a modification example of the operation of the liquid crystal display device and a procedure of the image display method according to the first embodiment.

In FIG. 19, Steps S21 to S23 are the same as Steps S11 to S13 of FIG. 18. In Step 24, light emission luminance calculator 22 obtains the light emission luminances B of lights that are expected from multiple regions of backlight device 35, and further, in Step S26, obtains light emission luminances Bo of lights from light sources 352 themselves on multiple regions of backlight device 35, using a calculation equation that employs light emission luminance B and a conversion coefficient. In Step S25, non-uniformization processor 21 multiplies the light emission luminances Bo by the coefficient p, and sets the result as light emission luminance Bo'. Further, in Step S27, PWM timing generator 24 and backlight driver 36 causes light sources 352 on multiple regions of backlight device 35 to emit light at light emission luminance Bo' with synchronization established by Step S23.

Figure 20:
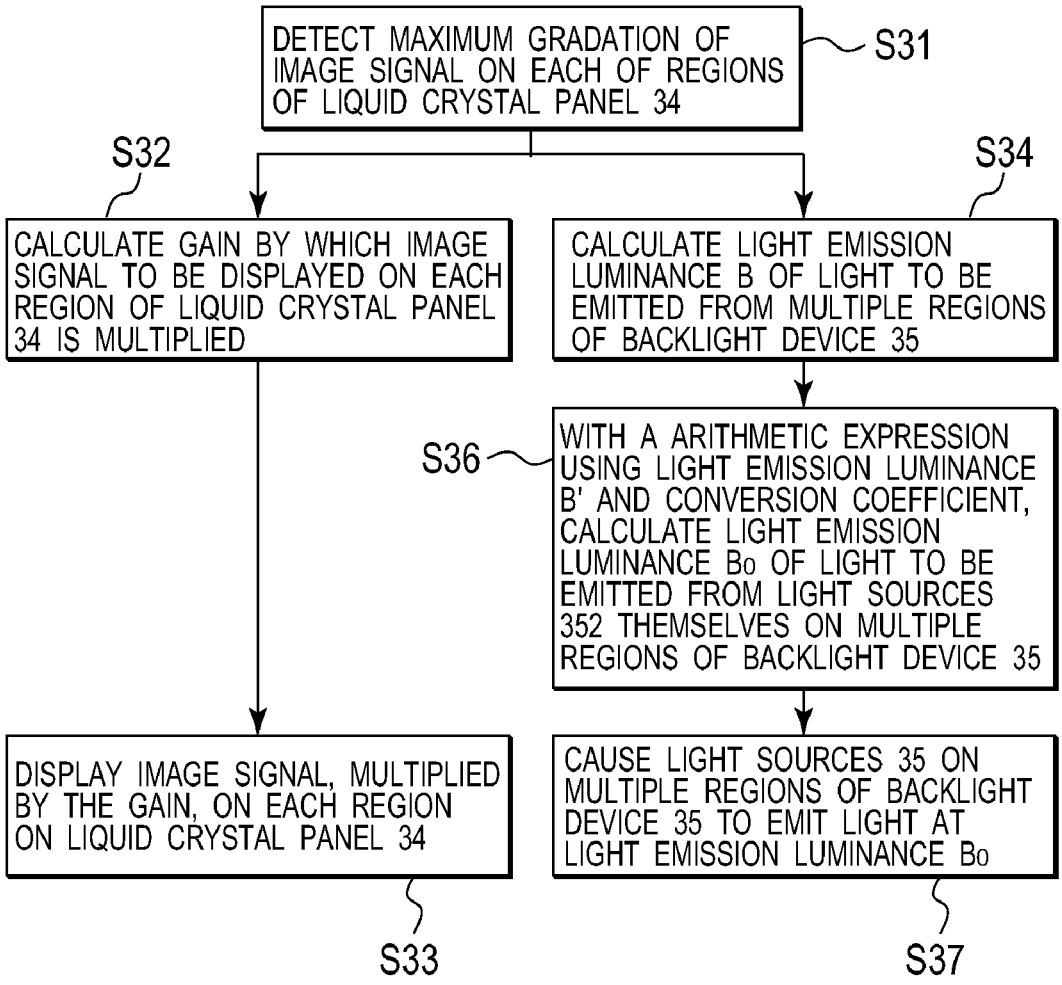
FIG. 20 is a flowchart showing another modification example of the operation of liquid crystal display device and a procedure of the image display method according to the first embodiment.

Incidentally, a non-uniformization process by non-uniformization processor 21 is necessary when it is desired to further reduce power consumption of backlight device 35 over the configurations described in Non-Patent Document 1 and Patent Documents 1 to 3 described above; however, when the level of required power consumption is the same as that in the configurations of the above-mentioned documents, it is possible to eliminate non-uniformization processor 21. Operation and a representative procedure in this case will be described referring to FIG. 20. In FIG. 20, Steps S31 to S33 are the same as Steps S11 to S13 of FIG. 18. In Step 34, light emission luminance calculator 22 obtains light emission luminances B of lights which are expected to emit from multiple regions of backlight device 35, and further, in Step S36, obtains light emission luminances Bo of lights to emit from light sources 352 themselves on multiple regions of the backlight device 35, with a calculation equation using the light emission luminance B and a conversion coefficient. Further, in Step S37, PWM timing generator 24 and backlight driver 36 causes light sources 352 on multiple regions of backlight device 35 to emit light at light emission luminance Bo with synchronization established via Step S33.

As described above, in the liquid crystal display device of the first embodiment, backlight device 35 has a structure wherein light emitted from respective light sources 352 of multiple regions are allowed to leak to other regions, so that it is not necessary to establish an accurate correspondence between the regions of liquid crystal panel 34 and the regions of backlight device 35. Further, it is possible to accurately obtain the light emission luminances B of lights emitted from the multiple regions of backlight device 35, using the light emission luminances Bo of light sources 352 themselves in the case where light sources 352 of the respective regions individually emit. Therefore, it is possible to accurately control the luminances of backlights that irradiate multiple regions on liquid crystal panel 34 according to the brightness of image signals to be displayed on these regions.

Further, the respective regions of liquid crystal panel 34 are not completely independent, and light emission luminances Bo are obtained by considering the structure in which light emitted from each of light sources 352 leaks to other regions through use of a calculation equation. Therefore, it is possible to enhance the quality of images displayed on liquid crystal panel 34 so that non-uniformities in brightness and color do not tend to occur on multiple regions of liquid crystal panel 34.

Second Embodiment

Figure 21:
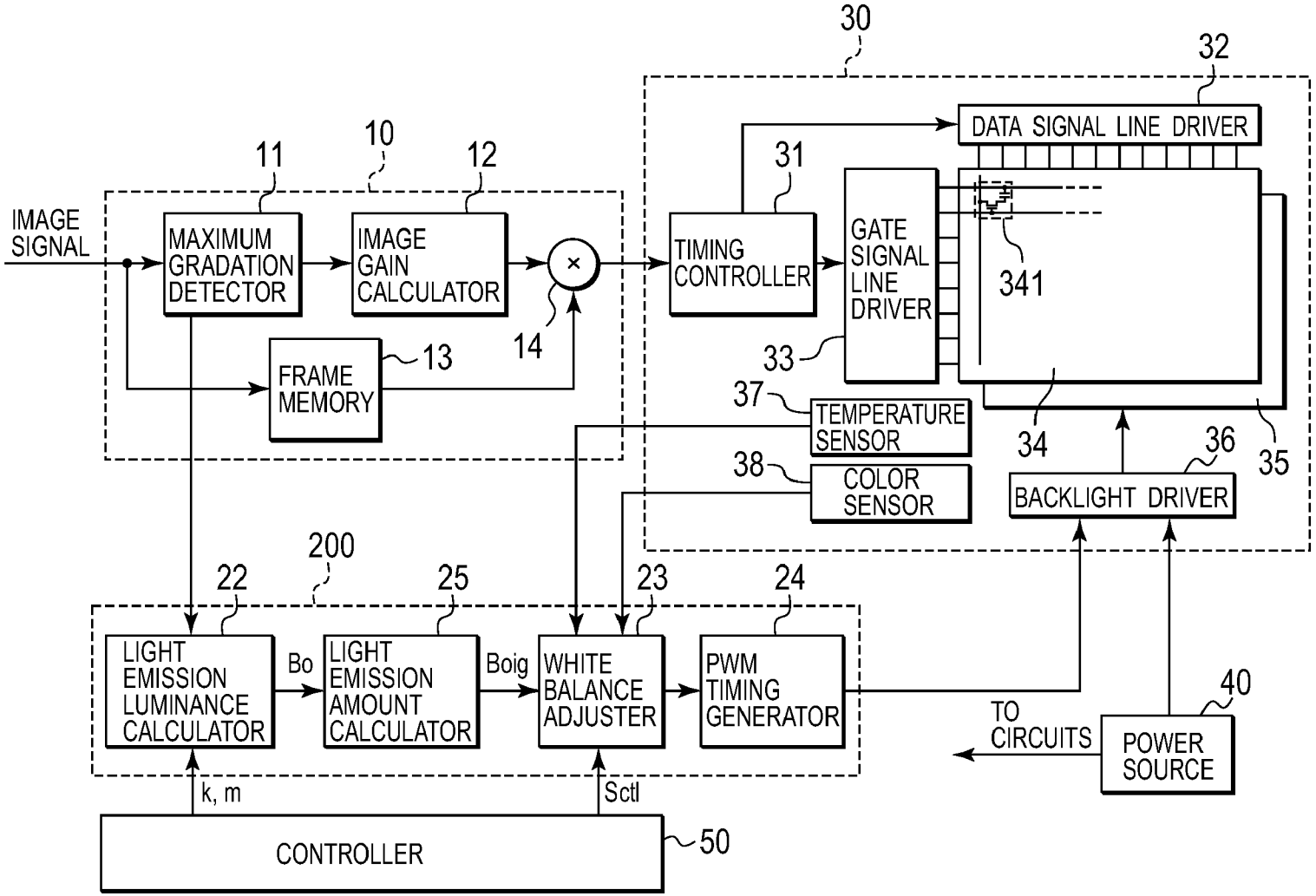
FIG. 21 is a block diagram showing an entire configuration of a liquid crystal display device according to a second embodiment.

FIG. 21 is a block diagram showing the entire configuration of a liquid crystal display device of a second embodiment. In FIG. 21, the parts that are the same as those shown in FIG. 1 are given the same reference numerals, so that further description thereof is omitted. Further, for the sake of simplicity in, the configuration of FIG. 21, the non-uniformization processor 21 of FIG. 1 has been eliminated, but this may include non-uniformization processor 21 in FIG. 1 as in the first embodiment.

Figure 22A:
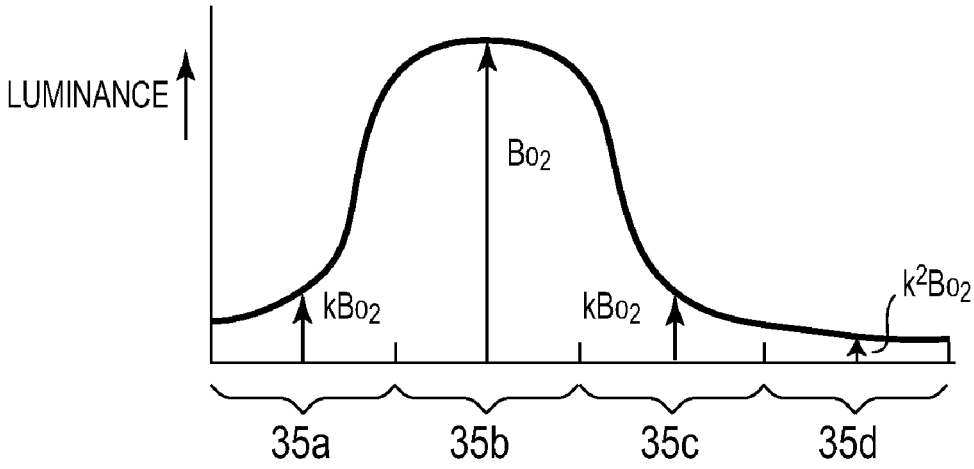
FIG. 22 shows graphs for describing the second embodiment.
Figure 22B:
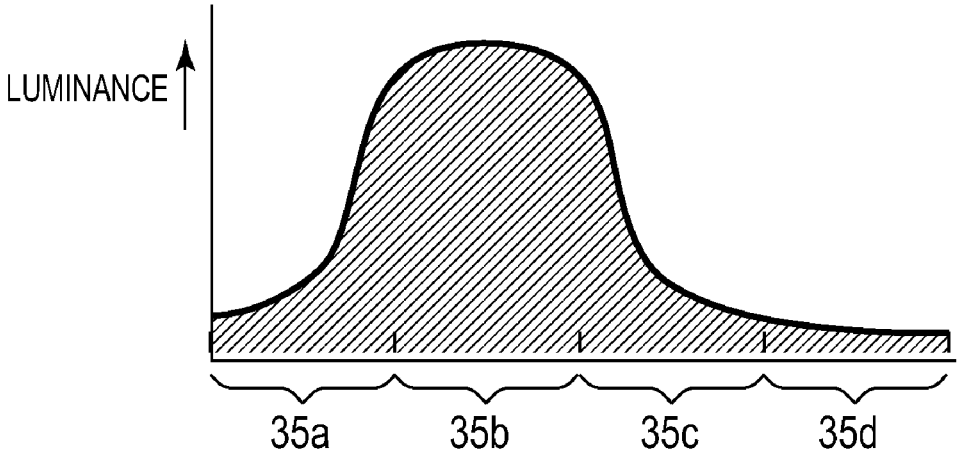

As described above, in the first embodiment, light emission luminance calculator 22 calculates light emission luminances Bo of lights from light sources 352 themselves of multiple regions of backlight device 35, and causes each light source 352 of multiple regions to emit light. The light emission luminances Bo each indicate a luminance value at the center of each one of the regions. FIG. 22A shows luminance distribution in the case where only region 35*b* emits light. Here, region 35*b* is one of four regions of backlight device 35A into which backlight device 35 is divided in the vertical direction as in FIG. 4A. When region 35*b* emits light at light emission luminance $Bo_2$ shown in FIG. 22A, the light emission luminances of regions 35*a* and 35*c* each become $kBo_2$, and that of region 35*d* becomes $k^2Bo_2$. This forms a luminance distribution such as shown in the drawing. In this case, the amount of light emitting from light source 352 of region 35*b* can be indicated by the region with hatch lines seen in FIG. 22B. That is, the amount of light shown in FIG. 22B is represented by an integral value of light in a range of the luminance distribution of FIG. 22A.

Preferably light emission luminances B of lights emitted from multiple regions are obtained using an integral value of light emitted from light source 352, rather than based on light emission luminance Bo of light that emits from light source 352 itself of each region. For this reason, in the second embodiment shown in FIG. 21, between light emission luminance calculator 22 and white balance adjustor 23, an amount-of-emitted light calculator 25 is provided, which converts light emission luminance Bo into an amount of emitted light Boig as an integral value. The amount of emitted light Boig can be easily obtained from a calculation equation, which converts light emission luminance Bo into amount of emitted light Boig.

FIG. 23A is a calculation equation in the embodiment wherein backlight device 35 is backlight device 35A. FIG. 23B shows constants $s_1$ to $s_4$ in Eq. (15) shown in FIG. 23A, and expresses these constants $s_1$ to $s_4$ by Eq. (16), using an attenuation constant k. Further, the equations shown in FIGS. 23A and 23B are approximate and convert a light emission luminance Bo into amount of emitted light Boig. For example, when region 35*a* of backlight device 35A emits light, an integral value of a light irradiating liquid crystal panel 34 can be approximately expressed by Eq. (17) of FIG. 24, and the term $k^3$ is sufficiently small, hence being negligible, so that the integral value can be expressed by Eq. (18). Further, when region 35*b* of backlight device 35A emits light, an integral value of light irradiating liquid crystal panel 34 can be approximately expressed by Eq. (19), and rearranging of Eq. (19) gives Eq. (20). When partitioning backlight device 35 into multiple regions in the vertical direction, a coefficient s by which light emission luminances Bo of regions located on upper and lower ends are multiplied is equal to 1+k, and a coefficient s by which light emission luminances Bo of respective regions sandwiched by those on upper and lower ends are multiplied is equal to (1+k)/(1−k).

FIG. 25A indicates a calculation equation for obtaining an amount of emitted light Boig based on light emission luminance Bo, in the example of backlight device 35B shown in FIGS. 4 and 14. Constants $s_1$ to $s_4$ in Eq. (21) shown in FIG. 25A are given by Eq. (16) shown in FIG. 23B, and constants $t_1$ to $t_4$ can be expressed by Eq. (22) of FIG. 25B, by using an attenuation coefficient m. When partitioning backlight device 35 in both horizontal and vertical directions, coefficient s by which light emission luminances Bo of regions located on upper and lower ends are multiplied, is represented as equal to 1+k, and coefficient s by which light emission luminances Bo of respective regions sandwiched by those on upper and lower ends are multiplied, is equal to (1+k)/(1−k). Coefficient t, by which light emission luminances Bo of regions located on left and right ends are multiplied, is equal to 1+m, and coefficient t, by which light emission luminances Bo of respective regions sandwiched by those on the left and right ends are multiplied is equal to (1+m)/(1−m).

In FIG. 21, data indicative of the amount of light Boig output from amount-of-emitted light calculator 25 are supplied to PWM timing generator 24 through white balance adjustor 23. PWM timing generator 24 generates PWM timing data for adjusting the duration of a pulse duration modulation signal for generation by backlight driver 36, based on data indicative of the amount of emitted light Boig. Thus, in the second embodiment, backlight driver 36 drives light sources 352 of respective regions according to emitted light Boig from light sources 352 of the respective regions of backlight device 35, so that it becomes possible to control light emission luminances B of light from multiple regions more adequately than the first embodiment.

The calculation equations converting the light emission luminances Bo into amounts of emitted light Boig as described using FIGS. 23 to 25 are those for approximately obtaining the amount of emitted light Boig as described above, and not for completely representing an integral value of a light corresponding to a region with hatching shown in FIG. 22B. However, even when they are only approximate, it is possible to obtain a value for emitted light Boig that corresponds to the integral value of light. The integral value of a light may be more accurately obtained using a further complicated calculation equation.

Third Embodiment

Figure 26:
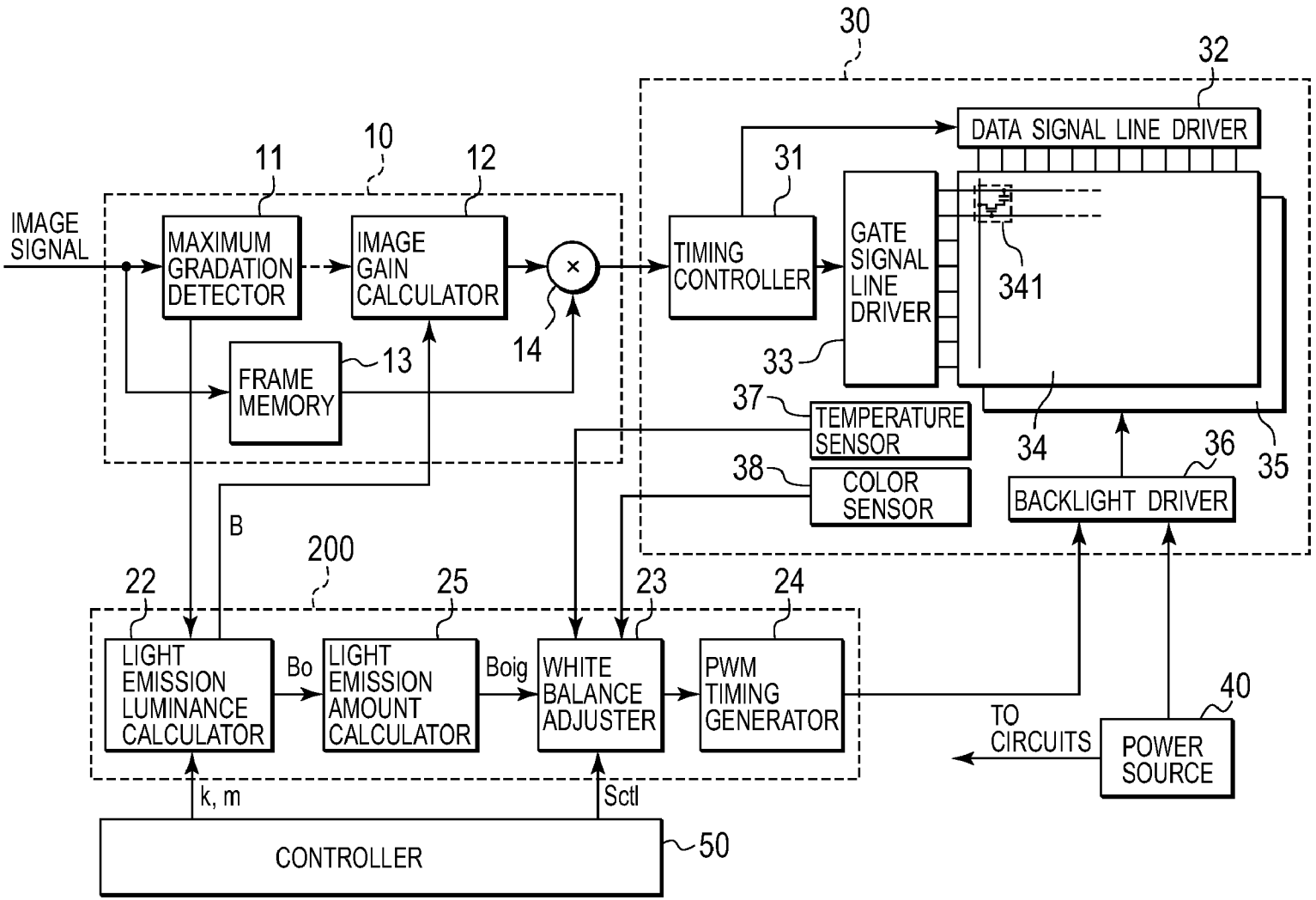
FIG. 26 is a block diagram showing an entire configuration of a liquid crystal display device according to a third embodiment.

FIG. 26 is a block diagram showing an entire configuration of a liquid crystal display device of a third embodiment. In FIG. 26, the parts which are the same as those shown in FIG. 1, are given the same reference numerals, so that a further description thereof is omitted. Further, for the sake of simplicity, the non-uniformization processor 21 in FIG. 1 has been eliminated from FIG. 26, but may include as in the case of the first embodiment. Further, the amount-of-emitted light calculator unit 25 has been included in FIG. 26 as in the second embodiment, but also may be eliminated.

Figure 27:
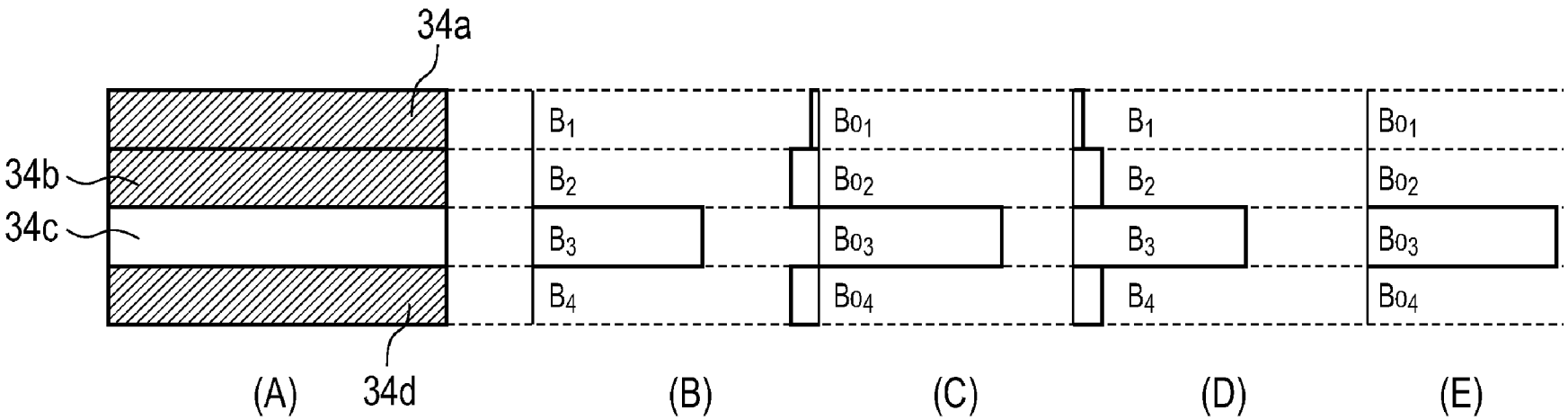
FIGS. 27A to 27E are diagrams for describing the third embodiment.

FIG. 27A is a view showing the case where liquid crystal panel 34A is divided into regions 34*a* to 34*d* so that regions 34*a* to 34*d* correspond to regions 35*a* to 35*d* of backlight device 35A respectively. This figure also shows the case where the gradations of regions 34*a*, 34*b*, and 34*d* are zero (i.e., black), and the gradation of region 34*c* is at maximum gradation 255 (i.e., white). In this case, light emission luminances B of light from regions 35*a* to 35*d* of backlight device 35A become $B_1$, $B_2$, $B_3$, and $B_4$ respectively as shown in FIG. 27B. In this case, light emission luminances Bo of light from light sources 352 themselves on regions 35*a* to 35*d* of backlight device 35 become $Bo_1$, $Bo_2$, $Bo_3$, and $Bo_4$ respectively in the calculation thereof as shown in FIG. 27C, and those on regions 35*a*, 35*b*, and 35*d* take negative values.

Here, suppose that: backlight device 35 is divided into n regions in the vertical direction; $Bo_1$ denotes light emission luminances of lights to be emitted from light sources 352 themselves of regions on an upper end; Bon denotes light emission luminances of lights to be emitted from light sources 352 themselves of regions on a lower end; and $Bo_i$ denotes light emission luminances of lights to be emitted from light sources 352 themselves of regions sandwiched by the upper and lower ends. In this case, $Bo_1$, $Bo_n$, and $Bo_i$ take negative values due to calculation when light emission luminances $B_1$, $B_i$, and $B_n$ of lights emitted from respective regions fall in the condition indicated by Eq. (23) of FIG. 28A. As shown in Eq. (23), the condition in which the light emission luminances Bo take negative values depends on the attenuation coefficient k.

Therefore, in the third embodiment, when light emission luminances $B_1$ to $B_n$ fall in the condition given in Eq. (23), the light emission luminances $B_1$ to $B_n$ are corrected so as to satisfy the condition given in Eq. (24) of FIG. 28B, and thereafter the light emission luminances Bo are obtained. In order to avoid conditions where Bo does not take negative values, Eq. (25) of FIG. 28C must be satisfied. Luminance values of B are allowed to take higher values using Eq. (24) over Eq. (25) not only in order to correct the light emission luminances B so as not to cause the light emission luminances Bo become negative, but also to allow the light emission luminances B to increase on purpose in a range in which viewing is adversely affected.

FIGS. 29A to 29F show conditions and corrections of light emission luminances B, in which light emission luminances Bo take negative values when the case where backlight device 35 is divided into multiple regions in both the horizontal and vertical directions. A subscript, i, of a light emission luminance B denotes an arbitrary i-th region in the vertical direction, and a subscript, j, denotes an arbitrary j-th region in the horizontal direction. Eq. (26) of FIG. 29A shows a condition for light emission luminances B in which light emission luminances Bo become negative by calculation on respective regions arranged in the vertical direction. When the light emission luminances B fall in a condition shown in Eq. (26), the light emission luminances B are first corrected so as to satisfy Eqs. (27) and (28) of FIGS. 29B and 29C, and thereafter the light emission luminances Bo are obtained.

Eq. (29) of FIG. 29D shows a condition for the light emission luminances B in which the light emission luminances Bo become negative in calculation on respective regions arranged in the horizontal direction. As shown in Eq. (29), the condition in which the light emission luminances Bo become negative in calculation in the case of the horizontal direction is determined depending on the attenuation coefficient m. When the light emission luminances B fall within the condition shown in Eq. (29), light emission luminances B are first corrected so as to satisfy Eqs. (30) and (31) of FIGS. 29E and 29F, and thereafter the light emission luminances Bo are obtained.

FIG. 27D shows light emission luminances B, the luminance values of which are corrected so that the light emission luminances Bo of negative values as shown in FIG. 27C do not occur. When obtaining light emission luminances B using the light emission luminances B shown in FIG. 27D, light emission luminances Bo do not become negative as shown in FIG. 27E.

Returning to FIG. 26, a configuration and operation of the third embodiment will be described. In the configuration of FIG. 1, image gain calculator 12 obtains a gain using data inputted from maximum gradation detector 11, the data indicating maximum gradations of respective regions of liquid crystal panel 34. However, the third embodiment shown in FIG. 26 is configured as follows. As shown in FIGS. 28 and 29, when the light emission luminances Bo become negative by calculation, light emission luminance calculator 22 corrects the light emission luminances B so that the luminance values of the light emission luminances Bo can be 0 or greater. Thereafter, light emission luminance calculator 22 obtains light emission luminances Bo based on the corrected light emission luminances B, and supplies the same to amount-of-emitted light calculator 25. The light emission luminances B thus corrected are supplied to image gain calculator 12. The image gain calculator 12 calculates a gain by which an image signal is multiplied, based on the corrected light emission luminances B.

Even in the case where image gain calculator 12 obtains a gain using data indicative of maximum gradations of image signals of respective regions, or even in the case where a gain is obtained using the corrected light emission luminances B, image gain calculator 12 is assumed to obtain a value as a gain for an image signal for each region. The value corresponds to that obtained by dividing a maximum gradation that the image signal may take, and wherein the maximum gradation is determined from a bit count of an image signal, by a maximum gradation of an image signal on each region.

In this third embodiment, it is not necessary to supply data indicative of maximum gradations of respective regions from maximum gradation detector 11 to image gain calculator 12. As shown by a dashed arrow of FIG. 26 from maximum gradation detector 11 to image gain calculator 12, data indicative of maximum gradations of respective regions may be supplied from maximum gradation detector 11 to the image gain calculator 12 as in the first embodiment. It is also possible to obtain gains using the corrected light emission luminances B instead of the data indicative of maximum gradations, only when the light emission luminances Bo become negative in calculation.

Fourth Embodiment

The fourth embodiment maybe configure as described for any one of the above first to third embodiments. In the fourth embodiment, studies have been made on how luminance distribution characteristics should be treated is preferable, the luminance distribution characteristics being those of lights emitted from light sources 352 of backlight device 35, and this embodiment is configured, to which light sources 352 having preferable luminance distribution characteristics are adopted.

Figure 30A:
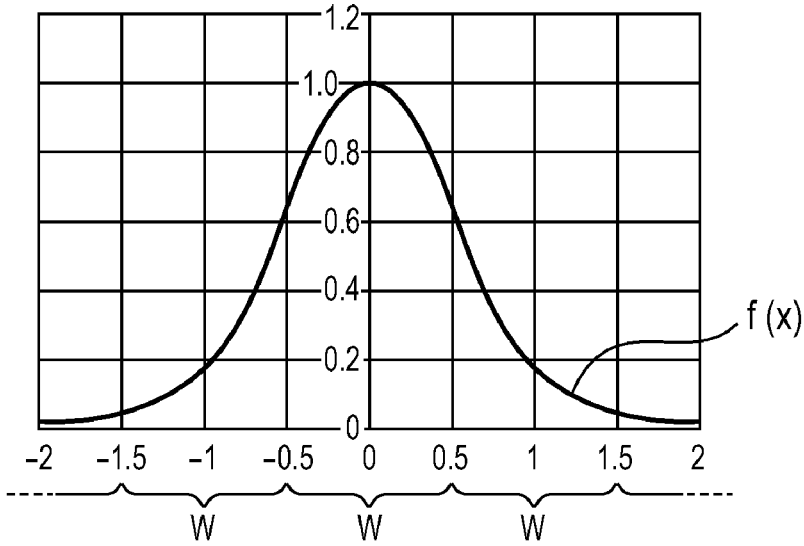
FIGS. 30A and 30B are characteristic charts for describing a liquid crystal display device according to a fourth embodiment.

FIG. 30A is a view showing luminance distribution characteristics of a light emitted from one light source 352 on one region of backlight device 35. For the sake of simplicity, the light source is assumed to be a point light source. The luminance distribution characteristics shown in FIG. 30A correspond to those in the case where a section is viewed, along which respective regions of backlight devices 35A and 35B are each in the vertical direction. In FIG. 30A, a vertical axis indicates luminance value, and a horizontal axis indicates distance from light source 352. Further, here, in the drawing, luminance values are indicated in which these are normalized with respect to a maximum luminance value being equal to 1 (central luminance). W represents the width of one region in the vertical direction. A curve depicted by the luminance distribution characteristics represents a luminance distribution function f(x).

Figure 30B:
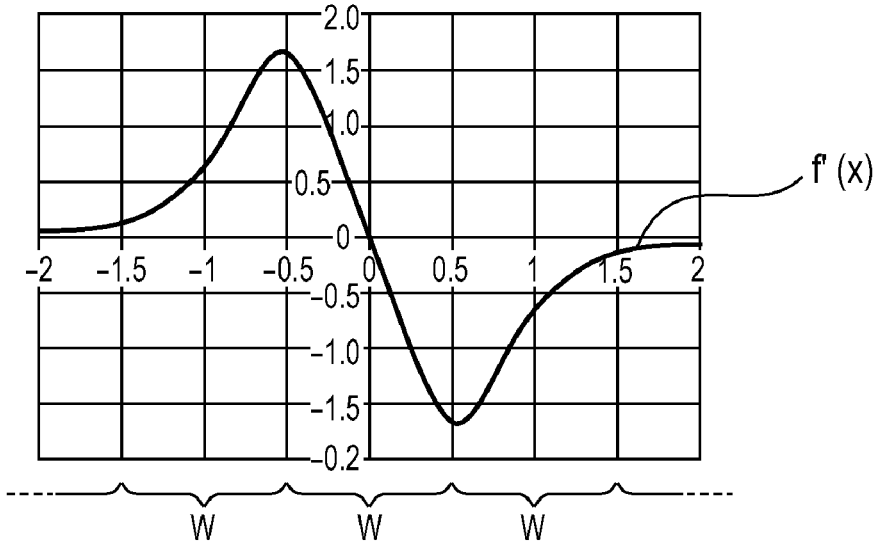

The inventors have conducted various experiments, and found that, for example, when causing one region of backlight device 35 to emit a light, a boundary of the region is viewed as a boundary step depending on the condition of the luminance distribution function f(x), thus deteriorating the quality of images displayed on liquid crystal panel 34. FIG. 30B shows a derived function f'(x) of the luminance distribution function f(x). From an experimental result, it has been confirmed that a maximum value (a maximum derivative of the luminance distribution function f(x)) of the derived function f'(x) influences visibility of the boundary step.

As shown in the following table 1, the inventors have selectively used, in backlight device 35, a plurality of light sources having fc1 to fc2 being a luminance distribution functions f(x), luminance distribution characteristics of which are different from each other, and studied the visibility of the boundary step.

TABLE 1

| | fc1 | fc2 | fc3 | fc4 | fc5 | fc6 | fc7 | fc8 |
|---|---|---|---|---|---|---|---|---|
| Maximum derivative | 1.2 | 1.4 | 1.6 | 1.8 | 2.0 | 2.2 | 2.5 | 3.0 |
| Presence of boundary step | No | No | No | No | No | Yes | Yes | Yes |

Figure 31A:
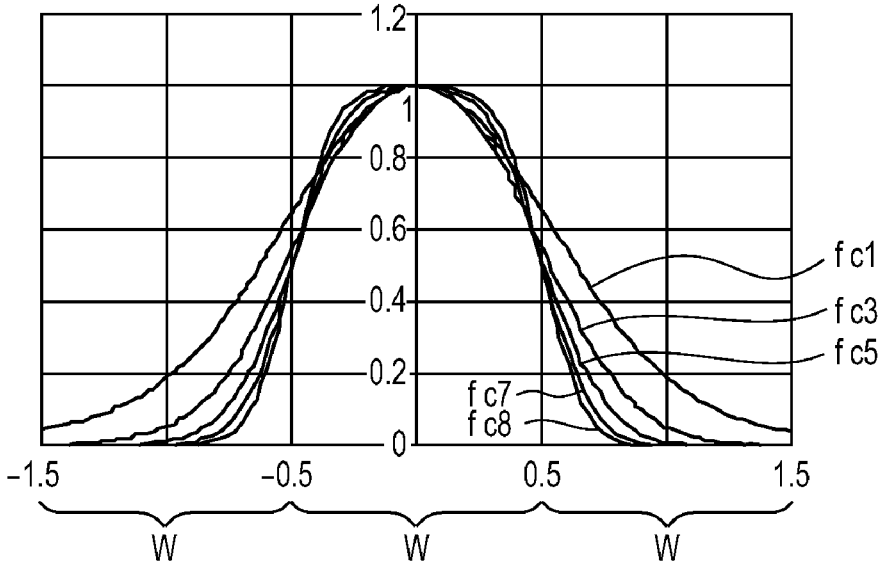
FIGS. 31A and 31B are characteristic charts for describing the liquid crystal display device according to the fourth embodiment.
Figure 31B:
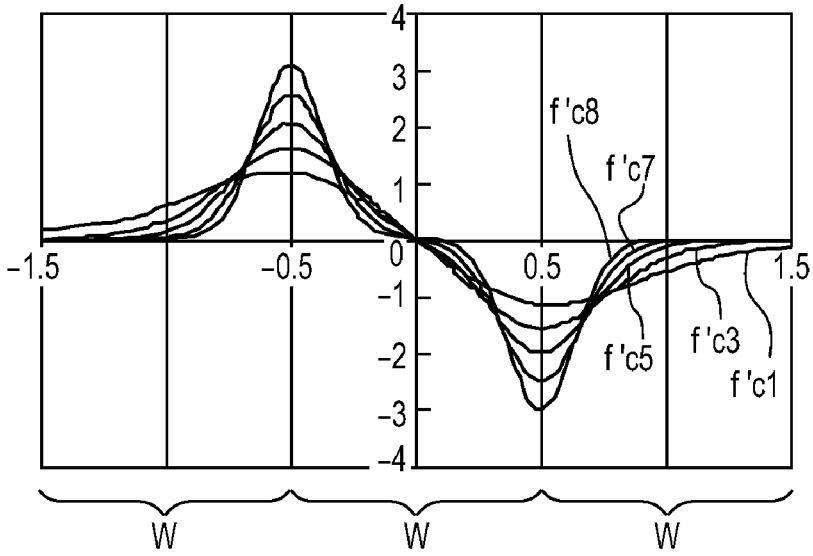

Of the luminance distribution functions fc1 to fc8 in Table 1, FIG. 31A shows fc1, fc3, fc5, fc7, and fc8; FIG. 31B shows derived functions f'c1, f'c3, f'c5, f'c7, and f'c8 of the luminance distribution functions fc1, fc3, fc5, fc7, and fc8. As shown in Table 1, in order not to make the boundary of the region as a boundary step, it is necessary to use light source 352 having luminance distribution characteristics indicative of a luminance distribution function f(x), an absolute value |f'(x)| of a derived function f'(x) of which takes a maximum value |f'(x)max| being equal to 2.0 or less. It is naturally necessary that a lower limit of the maximum value |f'(x)max" does not exceed 0. That is, it is necessary for the maximum value |f'(x)max| of the absolute value |f'(x)| of the derived function f'(x) to satisfy the condition: $0<|f'(x)max|\leqq 2.0$.

Here, the characteristics in the case where the region is cut in the vertical direction are shown. Light from light source 352 spreads concentrically with respect to light source 352 as a center with its luminance attenuated with distance from light source 352, so that the same is true also for the case where luminance distribution characteristics of a light from light source 352 are viewed from the horizontal direction or any direction other than the vertical direction.

As described above, in the fourth embodiment, as light source 352 of backlight device 35, one having the following condition is used: the maximum value of the absolute value of the derivative indicating a change in a slope of the luminance distribution function f(x) being represented by the curve of the luminance distribution characteristics is equal to 2.0 or less. Therefore, even when causing only part of a plurality of regions of backlight device 35 to emit light, a boundary of the region is not viewed as a boundary step so that the quality of images to be displayed on liquid crystal panel 34 is not deteriorated.

Figure 32:
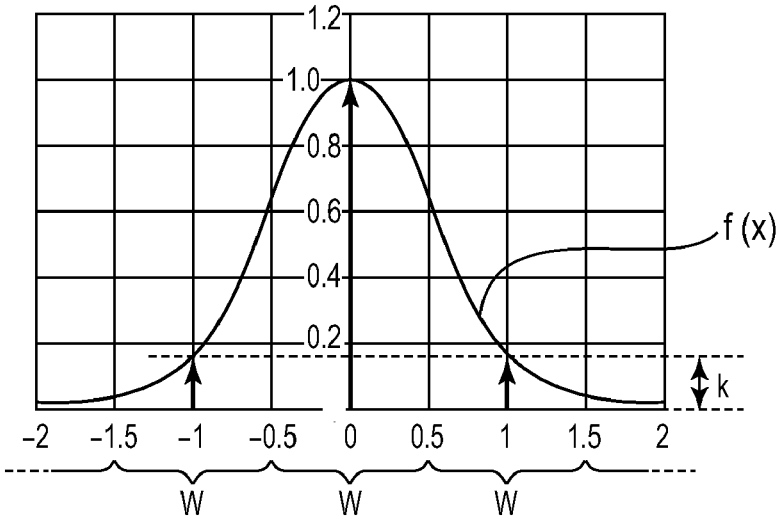
FIG. 32 is a characteristic chart for describing the liquid crystal display device according to the fourth embodiment.
Figure 33:
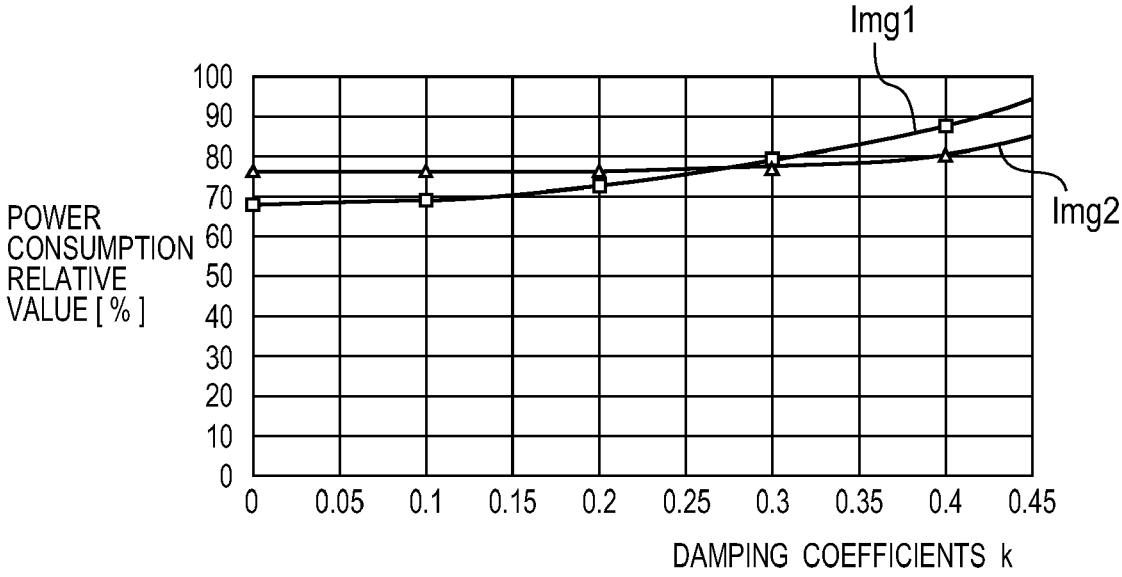
FIG. 33 is a characteristic chart showing the relationship between an attenuation constant k and a relative value of power consumption in the liquid crystal display device according to the fourth embodiment.

Further, preferable luminance distribution characteristics are which an effect of reduction of power consumption of backlight device 35 has been taken into account will be described. FIG. 32 is a view showing the same luminance distribution function f(x) as that of FIG. 30A. As shown in FIG. 32, when normalizing a central luminance of light source 352 to 1, a light from light source 352 leaks to an adjacent region with the attenuation coefficient k, so that the central luminance of the adjacent region becomes k. FIG. 33 is a view showing a relationship between an attenuation coefficient k and a power consumption relative value. In FIG. 33, with a horizontal axis indicative of the attenuation coefficient k and with a vertical axis indicative of the power consumption relative value, power consumption at the time when causing backlight device 35 to emit light at a maximum light emission luminance irrespective of gradation of image signals it set to 100%. Incidentally, in FIG. 33, Img1 and Img2 represent characteristics showing a relationship between attenuation values k and power consumption relative values for still images, pictures of which are different from each other.

As shown in FIG. 33, power consumption can be reduced by performing a luminance control of backlight device 35 as described in the first embodiment. As can be seen from FIG. 33, power consumption does not change much even when the attenuation coefficient k is increased, in the range of attenuation coefficient k being 0.3 or less. However, power consumption comparatively increases with increasing attenuation coefficient k, in the range of attenuation coefficient k exceeding 0.3. Therefore, it can be said that it is preferable that the attenuation coefficient k be 0.3 or less when considering the effect of reduction of power consumption of backlight device 35. The case for the attenuation coefficient k in the vertical direction has been described, but the same is true of the case for the attenuation coefficient m in the horizontal direction. That is, when lights emitted from respective light sources of a plurality of regions leak to regions adjacent in the vertical or horizontal direction to own regions, it is preferable that, when a central luminance of the own region is equal to 1, a central luminance of a region adjacent to the own region be greater than 0 and equal to 0.3 or less.

It is to be understood that the present invention is not limited to the above-described first to fourth embodiments, and various changes may be made therein without departing from the spirit of the present invention. Although liquid crystal panel 34 and backlight device 35 of the first to fourth embodiments are assumed to have a plurality of regions of the same area, different areas may be set to the regions when needed. Further, when an image display device which needs a backlight device is newly developed other than liquid crystal display devices, it is possible to naturally apply the present invention to the new image display device.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. A liquid crystal display device comprising:

a liquid crystal panel configured to display an image from image signals;

a backlight divided into regions and disposed on the back side of the liquid crystal panel, the backlight comprising light sources in the respective regions, the light sources positioned to emit light into the liquid crystal panel, and the backlight having a structure in which light emitted from each of the light sources of the plurality of regions is allowed to leak to regions other than the respective light source region;

a maximum gradation detector configured to detect, at predetermined intervals, a first maximum gradation of each of regional image signals displayed on regions of the liquid crystal panel that correspond to regions of the backlight device;

an image gain calculator configured to determine a gain value based on a value determined by dividing a second maximum gradation by the first maximum gradation, the second maximum gradation being a possible maximum gradation of the regional image signal and determined based on the number of bits of the regional image signal;

a multiplier configured to multiply a regional image signal by the gain obtained by the image gain calculator, and to output image signals for display on the liquid crystal panel; and an emission luminance calculator configured to determine the second emission luminance by multiplying a first emission luminance by a first coefficient, wherein the first emission luminance is the luminance from each region of the backlight obtained by multiplying the maximum luminance from the light source by the inverse number of the gain obtained by the image gain calculator, wherein the first coefficient is determined from the amount of light that leaks out of adjacent regions and the regions in the vicinity of adjacent regions into a given region, and wherein the second emission luminance is the luminance of light that each of the light sources of the plurality of regions of the backlight independently emits to obtain the first emission luminance.

2. The liquid crystal display device of claim 1, further comprising:

a light emission calculator configured to determine emission amount of light emitted to the liquid crystal from the light source for each backlight region, according to the second emission luminance; and a backlight driver configured to adjust light from each region of the backlight according to the output of the emission luminance calculator.

3. The liquid crystal display device of claim 1, wherein when the calculated second emission luminance is negative, the emission luminance calculator recalculates the second emission luminance from a revised first emission luminance to make the second emission luminance value equal to or greater than 0.

4. The liquid crystal display device of claim 3, wherein the image gain calculator determines a gain based on the first emission luminance corrected by the emission luminance calculator.

5. The liquid crystal display device of claim 1, wherein the light sources are configured for an absolute value of the maximum value of the derivative obtained by differentiating a curve representing a luminance distribution characteristic of light emitted by all the light sources of between 0 exclusive and 2 inclusive.

6. The liquid crystal display device of claim 5, wherein when light emitted from each light source region leaks into adjacent regions, the luminance of leaked light in the center of each said adjacent region is between 0 exclusive and 0.3 inclusive, wherein the luminance in the center of the light source region is 1.

7. The liquid crystal display device of claim 1, wherein the image gain calculator and emission luminance calculator operate on matrices.

8. The liquid crystal display device of claim 1, wherein the plurality of regions of the liquid crystal panel are obtained by dividing the liquid crystal panel one-dimensionally in a vertical direction.

9. The liquid crystal display device of claim 1, wherein the plurality of regions of the liquid crystal panel are obtained by dividing the liquid crystal panel two-dimensionally in horizontal and vertical directions.

10. The liquid crystal display device of claim 8, further comprising:

a non-uniformization processor configured to make the first emission luminance non-uniform by multiplying the first emission luminance of each backlight device region by a second coefficient to gradually lower the luminance on the liquid crystal panel from a center region in the vertical direction of regions one-dimensionally arranged in the liquid crystal panel, toward regions in the upper and lower ends of the panel.

11. The liquid crystal display device of claim 9, further comprising:

a non-uniformization processor configured to make the first emission luminance non-uniform by multiplying the first emission luminance of each backlight device region by a second coefficient to gradually lower the luminance on the liquid crystal panel from a center region in the vertical direction of regions one-dimensionally arranged in the liquid crystal panel, toward regions located in the upper and lower ends of the panel, and the luminance on the liquid crystal panel is lowered gradually from a center region in the horizontal direction of the plurality of regions one-dimensionally arranged in the liquid crystal panel, toward regions located in the left and right ends thereof.

12. The liquid crystal display device of claim 10, wherein the second coefficient is between 0.8 and 1.0.

13. The liquid crystal display device of claim 11, wherein the second coefficient is between 0.8 and 1.0.

14. The liquid crystal display as claimed in claim 1 wherein the light source of the backlight device comprises a light emitting diode.

15. The liquid crystal display as claimed in claim 1, wherein each region is optically isolated by a partition wall generally perpendicular to the liquid crystal panel surface and wherein the structure of the backlight that allows light to leak into regions other than the respective light source regions comprises a space between the tops of the partition walls and the liquid crystal panel.

16. The liquid crystal display as claimed in claim 1, further comprising dome lenses between the light sources and the liquid crystal panel surface.

17. An image displaying method comprising:

detecting, at predetermined intervals, a first maximum gradation of each regional image signal displayed on regions of a liquid crystal panel, while treating image signals to be displayed on the liquid crystal panel as regional image signals respectively corresponding to regions of the liquid crystal panel;

obtaining, a gain factor for each regional image signal, based on a value determined by dividing a second maximum gradation by the first maximum gradation, the second maximum gradation being a possible maximum gradation of the regional image signal and determined according to the number of bits of the regional image signal;

multiplying the regional image signal by the gain factor and supplying the resultant regional image signal to the liquid crystal panel;

obtaining a second emission luminance by multiplying a first emission luminance with a first coefficient, wherein a backlight device of the liquid crystal panel is divided into regions corresponding to the regions of the liquid crystal panel, where the first emission luminance is light emitted by each region of the backlight device, and is obtained by multiplying the maximum light source luminance by the inverse of the gain obtained by the image gain calculator, where the second emission luminance is the luminance that each light source from regions of the backlight device should independently emit to obtain the first emission luminance, and wherein the first coefficient is based on the amount of light that is emitted from each region light source and allowed to leak to other regions; and displaying an image signal on each liquid crystal panel region, the image signal obtained by multiplying the corresponding regional image signal by the gain, while causing a light source for each region of the backlight device to emit light based on the calculated second emission luminance.

18. The method of claim 17, further comprising obtaining an emission amount of light to be emitted to the liquid crystal panel by the light source of each of the regions of the backlight device based on the second emission luminance, wherein the displaying image signal on each liquid crystal panel region includes displaying an image signal on the liquid crystal panel region, while causing the light source for each region of backlight device to emit light based on the emission amount of light.

19. The method of claim 17, wherein when the second emission luminance takes a minus value as a result of calculation when the second emission luminance is calculated by using the operation expression, the second emission luminance is obtained after the first emission luminance and is corrected so that the second emission luminance is equal to or greater than 0.

20. The method of claim 19, wherein the gain is calculated by correcting the first emission luminance by the emission luminance calculator.

21. The method of claim 17, wherein an image signal is displayed on each liquid crystal panel region and obtained by multiplying the corresponding regional image signal while causing the light source of each backlight device region to emit light at the second emission luminance, wherein the light sources follow the characteristic in which the absolute value of the maximum value of the derivative obtained by differentiating a curve representing a luminance distribution characteristic of light emitted by all the light sources is between 0 exclusive and 2 inclusive.

22. The method of claim 21, wherein when light from each region light source leaks to adjacent regions, the backlight device has a leaked light luminance in the center of each adjacent region between 0 exclusive and 0.3 inclusive, with respect to the leaking region light source.

23. The liquid crystal display device as claimed in claim 1, wherein light emission luminescences in regions along a periphery of the liquid crystal panel are further adjusted below their said calculated values.

* * * * *